US009599378B2

(12) United States Patent
Yamashita et al.

(10) Patent No.: US 9,599,378 B2
(45) Date of Patent: Mar. 21, 2017

(54) AIR-CONDITIONING APPARATUS

(75) Inventors: Koji Yamashita, Tokyo (JP); Hiroyuki Morimoto, Tokyo (JP); Katsuhiro Ishimura, Tokyo (JP); Shinichi Wakamoto, Tokyo (JP); Naofumi Takenaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 750 days.

(21) Appl. No.: 13/884,986

(22) PCT Filed: Jan. 31, 2011

(86) PCT No.: PCT/JP2011/000515

§ 371 (c)(1),
(2), (4) Date: May 13, 2013

(87) PCT Pub. No.: WO2012/104892

PCT Pub. Date: Aug. 9, 2012

(65) Prior Publication Data

US 2013/0239602 A1 Sep. 19, 2013

(51) Int. Cl.

| | |
|---|---|
| ***F25B 29/00*** | (2006.01) |
| ***F25B 1/10*** | (2006.01) |
| ***F25B 13/00*** | (2006.01) |
| *F25B 25/00* | (2006.01) |

(52) U.S. Cl.

CPC ..... *F25B 29/003* (2013.01); *F25B 1/10* (2013.01); *F25B 13/00* (2013.01); *F25B 25/005* (2013.01); *F25B 2313/023* (2013.01); *F25B 2313/0231* (2013.01); *F25B 2313/0272* (2013.01); *F25B 2313/02732* (2013.01);

(Continued)

(58) Field of Classification Search

CPC ..... F25B 29/0003; F25B 13/00; F25B 1/10; F25B 2400/121; F25B 2313/023; F25B 2313/0272

See application file for complete search history.

(56) References Cited

U.S. PATENT DOCUMENTS 4,742,694 A * 5/1988 Yamanaka ..... F25B 1/02 62/510
5,309,733 A * 5/1994 Hayashida ..... F24F 3/065 62/278

(Continued)

FOREIGN PATENT DOCUMENTS

EP 1 818 627 A1 8/2007
JP H07146032 A * 3/1995

(Continued)

OTHER PUBLICATIONS

Hidehiko et al., Air Conditioner, Aug. 1, 1995, JPH07198187A, Whole Document.*

(Continued)

*Primary Examiner* — Larry Furdge
(74) *Attorney, Agent, or Firm* — Posz Law Group, PLC

(57) ABSTRACT

A heat pump hot-water supply apparatus controls a second expansion device during a heating operation so as to adjust the amount of refrigerant flowing through an injection pipe, and controls a third expansion device during a cooling operation so as to adjust the amount of refrigerant flowing through the injection pipe.

19 Claims, 14 Drawing Sheets

(52) U.S. Cl.
CPC ..... *F25B 2313/02741* (2013.01); *F25B 2400/121* (2013.01); *F25B 2700/21152* (2013.01)

(56) References Cited

U.S. PATENT DOCUMENTS

| | | | | | |
|---|---|---|---|---|---|
| 5,680,898 | A * | 10/1997 | Rafalovich | F24F 5/0017 165/236 |
| 6,148,631 | A * | 11/2000 | Watanabe | F25B 41/003 181/196 |
| 7,024,879 | B2 * | 4/2006 | Nakatani | F25B 1/10 62/324.1 |
| 2005/0086969 | A1 | 4/2005 | Lifson et al. | |
| 2005/0284164 | A1 * | 12/2005 | Ohta | F25B 49/02 62/228.3 |
| 2007/0151266 | A1 * | 7/2007 | Yakumaru | F25B 1/10 62/197 |

FOREIGN PATENT DOCUMENTS

| | | | | |
|---|---|---|---|---|
| JP | H07198187 | A | * | 8/1995 |
| JP | 2001-317820 | A | | 11/2001 |
| JP | 2002-107002 | A | | 4/2002 |
| JP | 2003-314930 | A | | 11/2003 |
| JP | 2003343936 | A | * | 12/2003 |
| JP | 2005-282972 | A | | 10/2005 |
| JP | 2007-263443 | A | | 10/2007 |
| JP | 2008-138921 | A | | 6/2008 |
| JP | 2009-127902 | A | | 6/2009 |
| JP | 2009-222363 | A | | 10/2009 |
| JP | 2009-270822 | A | | 11/2009 |
| JP | 2010-096360 | A | | 4/2010 |
| JP | 2010-276239 | A | | 12/2010 |
| WO | 2009/136581 | A1 | | 11/2009 |
| WO | 2009/154149 | A1 | | 12/2009 |
| WO | 2010/049998 | A1 | | 5/2010 |

OTHER PUBLICATIONS

Takashi et al., Refrigeration Cycle System, Dec. 3, 2003, JP2003343936A, Whole Document.*

Yuji, Expansion Valve, Jun. 6, 1995, JPH07146032A, Whole Document.*

Extended European Search Report dated Sep. 2, 2014 issued in corresponding EP patent application No. 11 85 7679.

Office Action mailed Sep. 30, 2014 in corresponding JP patent application No. 2012-555550 (with English translation).

Office Action dated Aug. 7, 2015 issued in corresponding CN patent application No. 201180059462.5 (and English translation).

Office Action mailed Jun. 11, 2014 issued in corresponding EP patent application No. 11857679.2 (in English).

Office Action mailed Mar. 18, 2014 issued in corresponding JP patent application No. 2012-555550 (and English translation).

International Search Report of the International Searching Authority mailed May 10, 2011 for the corresponding international application No. PCT/JP2011/000515 (with English translation).

Office Action dated Nov. 21, 2014 issued in corresponding CN patent application No. 201180059462.5 (and English translation).

* cited by examiner

AIR-CONDITIONING APPARATUS

CROSS REFERENCE TO RELATED APPLICATIONS

This application is a U.S. national stage application of PCT/JP2011/000515 filed on Jan. 31, 2011, the disclosure of which is incorporated herein by reference.

TECHNICAL FIELD

The present invention relates to an air-conditioning apparatus used as, for example, a multi-air-conditioning apparatus in a building.

BACKGROUND

Among air-conditioning apparatuses, such as multi-air-conditioning apparatuses used in a building, the following type of air-conditioning apparatus is known. By circulating a refrigerant from an outdoor unit to a relay unit and by circulating a heat medium, such as water, from the relay unit to an indoor unit, conveyance power of a heat medium, such as water, is reduced while circulating it in the indoor unit, thereby implementing a cooling and heating mixed operation (see, for example, Patent Literature 1).

The following type of air-conditioning apparatus is also known. In order to reduce the discharge temperature of a compressor, a circuit for injecting a liquid from a high-pressure liquid pipe in a refrigeration cycle into the compressor is provided in an air-conditioning apparatus. The air-conditioning apparatus can perform control so that the discharge temperature will be maintained at a temperature regardless of the operating state (for example, see Patent Literature 2).

The following type of air-conditioning apparatus is also known. R32 is used as a refrigerant and is injected from the output side of a gas-liquid separator disposed in a high-pressure liquid pipe in a refrigeration cycle into a compressor (high-pressure shell compressor) in which an air-tight container is under a discharge pressure atmosphere (for example, see Patent Literature 3).

PATENT LITERATURE

Patent Literature 1: WO10/049,998 Publication (page 3, FIG. 1 and so on)

Patent Literature 2: Japanese Unexamined Patent Application Publication No. 2005-282972 (page 4, FIG. 1 and so on)

Patent Literature 3: Japanese Unexamined Patent Application Publication No. 2009-127902 (page 4, FIG. 1 and so on)

In the air-conditioning apparatus, such as a multi-air-conditioning apparatus used in a building, disclosed in Patent Literature 1, there is no problem if R410A, for example, is used as a refrigerant. However, if R32, for example, is used as a refrigerant, during a heating operation when the outdoor air temperature is low, the discharge temperature of a compressor becomes excessively high, which may deteriorate the refrigerant and refrigerating machine oil. Moreover, although a description of a cooling and heating concurrent operation is given in Patent Literature 1, it does not discuss whatsoever a method for reducing the discharge temperature. Generally, in a multi-air-conditioning apparatus used in a building, an expansion device, such as an electronic expansion valve, which decompresses a refrigerant, is installed in a relay unit or an indoor unit, which is disposed away from an outdoor unit.

Concerning the air-conditioning apparatus disclosed in Patent Literature 2, only an injection method for injecting a liquid from a high-pressure liquid pipe is described, and the air-conditioning apparatus disclosed in Patent Literature 2 does not support cases, for example, a case in which the circulation channel in a refrigeration cycle is reversed (switching between a cooling operation and a heating operation). Additionally, the air-conditioning apparatus disclosed in Patent Literature 2 does not support a cooling and heating mixed operation.

Concerning the air-conditioning apparatus disclosed in Patent Literature 3, an injection method for injecting a liquid from a high-pressure liquid pipe both during a cooling operation and a heating operation by using a plurality of check valves is disclosed. However, an expansion device, such as an electronic expansion valve, is not installed in an indoor unit. Accordingly, the air-conditioning apparatus disclosed in Patent Literature 3 is applicable only when an expansion valve is installed in an outdoor unit. It is noted that a compressor having a high-pressure shell structure is used in the air-conditioning apparatus disclosed in Patent Literature 3. Additionally, the air-conditioning apparatus disclosed in Patent Literature 3 does not support a cooling and heating mixed operation.

SUMMARY

The present invention has been made in order to deal with the above-described problems. Accordingly, it is an object of the present invention to provide an air-conditioning apparatus that can effectively suppress deterioration of a refrigerant and refrigerating machine oil by reliably performing control so that the discharge temperature does not become excessively high.

Solution to Problem

In an air-conditioning apparatus according to the present invention, a refrigerant circuit is formed by connecting a compressor having a low-pressure shell structure, a refrigerant flow switching device, a first heat exchanger, a first expansion device, and a second heat exchanger by using a pipe, due to working of the refrigerant flow switching device, a cooling operation and a heating operation are switchable, wherein the cooling operation is an operation in which the first heat exchanger serves as a condenser due to a high-pressure refrigerant being flowed into the first heat exchanger and the second heat exchanger serves as an evaporator due to a low-pressure refrigerant being flowed into part of or whole of the second heat exchanger, and the heating operation is an operation in which the first heat exchanger serves as an evaporator due to a low-pressure refrigerant being flowed into the first heat exchanger and the second heat exchanger serves as a condenser due to a high-pressure refrigerant being flowed into part of or whole of the second heat exchanger. The air-conditioning apparatus includes: a branch pipe that connects between a portion that is positioned on a downstream side of the first heat exchanger during the cooling operation and that is positioned on a downstream side of the compressor during the heating operation, and a portion that is positioned on the upstream side of the compressor during the cooling operation and is positioned on the upstream side of the first heat exchanger during the heating operation; an injection pipe that connects between the branch pipe and a compression chamber of the compressor which is in a course of performing compression; a second expansion device that is positioned on an upstream side of the compressor during the cooling operation and that is positioned on an upstream side of the first heat exchanger during the heating operation; a third expansion device that is provided in the branch pipe on a connection portion between the injection pipe and a pipe that is positioned between the first heat exchanger and the first expansion device during the cooling operation, and that is positioned between the compressor and the second heat exchanger during the heating operation; and a controller that controls the second expansion device during the heating operation so as to adjust a flow rate of the refrigerant to flow through the injection pipe and that controls the third expansion device during the cooling operation so as to adjust a flow rate of the refrigerant to flow through the injection pipe.

In an air-conditioning apparatus according to the present invention, by a refrigerant injection using an injection pipe, it is possible to perform control, regardless of the operation mode, so that the discharge temperature of a refrigerant discharged from a compressor will not become excessively high, thereby preventing deterioration of a refrigerant and refrigerating machine oil and continuing a safe operation.

DETAILED DESCRIPTION

Embodiments of the present invention will be described below with reference to the drawings.

Embodiment 1

Figure 1:
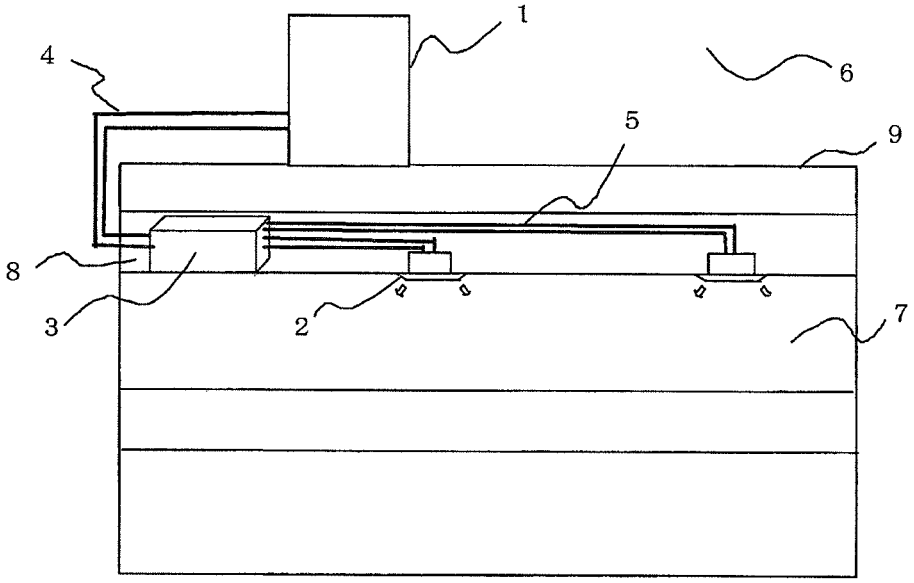
FIG. 1 is a schematic view illustrating an example in which an air-conditioning apparatus according to Embodiment 1 of the present invention is installed.

FIG. 1 is a schematic view illustrating an example in which an air-conditioning apparatus according to Embodiment 1 of the present invention is installed. An installation example of the air-conditioning apparatus will be described below with reference to FIG. 1. In this air-conditioning apparatus, by utilizing a refrigeration cycle (refrigerant circuit A and heat medium circuit B) in which refrigerants (a heat source side refrigerant and a heat medium) circulate, each indoor unit is capable of freely selecting a cooling mode or a heating mode as an operating mode. In the following drawings including FIG. 1, the correspondence between the sizes of components is not always the same as the actual correspondence.

In FIG. 1, the air-conditioning apparatus of Embodiment 1 includes one outdoor unit 1, which is a heat source device, a plurality of indoor units 2, and a heat medium relay unit 3 interposed between the outdoor unit 1 and the indoor units 2. The heat medium relay unit 3 performs heat exchange between a heat source side refrigerant and a heat medium. The outdoor unit 1 and the heat medium relay unit 3 are connected to each other with refrigerant pipes 4 which allow a heat source side refrigerant to pass therethrough. The heat medium relay unit 3 and the indoor units 2 are connected to each other with pipes (heat medium pipes) 5 which allow a heat medium to pass therethrough. Then, cooling energy or heating energy generated in the outdoor unit 1 is distributed to the indoor units 2 through the heat medium relay unit 3.

The outdoor unit 1 is generally installed in an outdoor space 6, which is a space outside a building 9 (for example, a rooftop), and supplies cooling energy or heating energy to the indoor units 2 via the heat medium relay unit 3. The indoor units 2 are installed at positions at which they can supply cooling air or heating air to an indoor space 7, which is a space inside the building 9 (for example, a living room), and supply cooing air or heating air to the indoor space 7, which is an air-conditioned space. The heat medium relay unit 3 is provided as a casing different from the outdoor unit 1 or the indoor units 2 and is configured such that they can be installed at a position different from the outdoor space 6 or the indoor space 7. The heat medium relay unit 3 is connected to the outdoor unit 1 and the indoor units 2 with the refrigerant pipes 4 and the pipes 5, respectively, and transmits cooling energy or heating energy supplied from the outdoor unit 1 to the indoor units 2.

As shown in FIG. 1, in the air-conditioning apparatus according to Embodiment 1, the outdoor unit 1 and the heat medium relay unit 3 are connected to each other by using the two refrigerant pipes 4, and the heat medium relay unit 3 and each of the indoor units 2 are connected to each other by using the two pipes 5. In this manner, in the air-conditioning apparatus according to Embodiment 1, the units (the outdoor unit 1 and the heat medium relay unit 3) are connected to each other by using two pipes (the refrigerant pipes 4) and the units (each of the indoor units 2 and the heat medium relay unit 3) are connected to each other by using two pipes (the pipes 5), thereby facilitating the construction of the air-conditioning apparatus.

In FIG. 1, there is shown a state, by way of example, in which the heat medium relay unit 3 is installed in a space, for example, above a ceiling (hereinafter simply referred to as a "space 8"), which is different from the indoor space 7, though the space 8 is positioned within the building 9. Alternatively, the heat medium relay unit 3 may be installed in a common use space, such as a space in which an elevator or the like is installed. In FIG. 1, a case in which the indoor units 2 are of a ceiling cassette type is shown by way of example. However, the indoor units 2 are not restricted to this type, and may be any type, such as a ceiling concealed type or a ceiling suspended type, as long as they can blow heating air or cooling air to the indoor space 7 directly or through a duct.

In FIG. 1, a case in which the outdoor unit 1 is installed in the outdoor space 6 is shown by way of example. However, this is only an example, and the outdoor unit 1 may be installed in a surrounded space, such as a machine room with a ventilation opening, or may be installed within the building 9 as long as waste heat can be exhausted outside the building 9 by using an exhaustion duct. Alternatively, a water-cooled outdoor unit 1 may be used and installed within the building 9. No matter in which place the outdoor unit 1 is installed, problems do not occur particularly.

The heat medium relay unit 3 may be installed near the outdoor unit 1. However, attention has to be paid that, if the distances from the heat medium relay unit 3 to the indoor units 2 are too long, conveyance power for a heat medium becomes considerably large, thereby reducing the power-saving effect. Moreover, the numbers of indoor units 1, outdoor units 2, and heat medium relay units 3 connected to each other are not restricted to those shown in FIG. 1, and may be decided depending on the building 9 in which the air-conditioning apparatus according to Embodiment 1 is installed.

If a plurality of heat medium relay units 3 are connected to one outdoor unit 1, they may be installed such that they are interspersed in a space, such as a common use space or a space above a ceiling, in a building. With this arrangement, an air conditioning load can be satisfied by heat exchangers related to heat medium within the individual heat medium relay units 3. Additionally, it is possible to install the indoor units 2 at a distance or with a height within a conveyance permissible range of a heat medium conveyance device disposed within each of the heat medium relay units 3. In this manner, the units can be arranged over an entire building.

Figure 2:
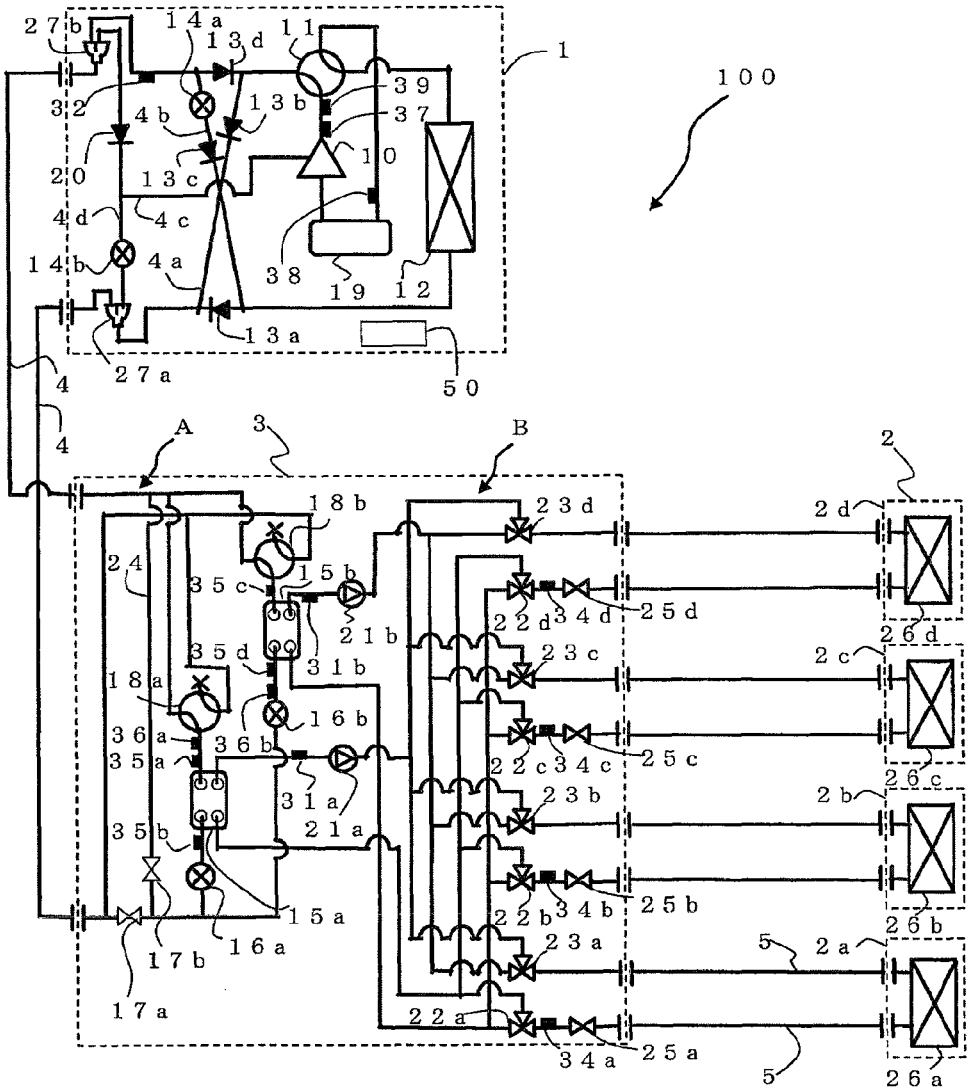
FIG. 2 is a schematic circuit diagram illustrating an example of a circuit configuration of the air-conditioning apparatus according to Embodiment 1.

FIG. 2 is a schematic circuit diagram illustrating an example of a circuit configuration of the air-conditioning apparatus according to Embodiment 1 (hereinafter referred to as an "air-conditioning apparatus 100"). A detailed configuration of the air-conditioning apparatus 100 will be discussed below with reference to FIG. 2. As shown in FIG. 2, the outdoor unit 1 and the heat medium relay unit 3 are connected to each other by using the refrigerant pipes 4 via heat exchangers 15*a* and 15*b* related to heat medium included in the heat medium relay unit 3. The heat medium relay unit 3 and each of the indoor units 2 are also connected to each other by using the pipes 5 via the heat exchangers 15*a* and 15*b* related to heat medium. Details of the refrigerant pipes 4 and the pipes 5 will be given later.

[Outdoor Unit 1]

In the outdoor unit 1, a compressor 10, a first refrigerant flow switching device 11, such as a four-way valve, a heat source side heat exchanger 12, and an accumulator 19 are mounted such that they are connected in series with one another by using the refrigerant pipes 4. The outdoor unit 1 also includes a first connecting pipe 4*a*, a second connecting pipe 4*b*, and check valves 13*a*, 13*b*, 13*c*, and 13*d*. By providing the first and second connecting pipes 4*a* and 4*b* and the check valves 13*a* through 13*d*, the flow of a heat source side refrigerant which flows into the heat medium relay unit 3 can be set in a unique direction regardless of the operation requested by the indoor units 2.

The compressor 10 sucks a heat source side refrigerant and compresses it to a high-temperature high-pressure state. The compressor 10 may be constructed as, for example, an inverter compressor, which can control the capacity. The first refrigerant flow switching device 11 switches between the flow of a heat source side refrigerant during a heating operation (during a heating only operation mode and a heating main operation mode) and the flow of a heat source side refrigerant during a cooling operation (during a cooling only operation mode and a cooling main operation mode). The heat source side heat exchanger 12 serves as an evaporator during a heating operation and serves as a condenser (or a radiator) during a cooling operation. The heat source side heat exchanger 12 performs heat exchange between air supplied from an air-sending device (not shown) and a heat source side refrigerant, thereby evaporating and gasifying or condensing and liquefying the heat source side refrigerant. The accumulator 19 is provided at the suction side of the compressor 10, and accumulates a surplus refrigerant produced by a difference between a heating operation and a cooling operation, or a surplus refrigerant produced by a change during the transition of the operation.

The check valve 13*d* is provided in the refrigerant pipe 4 between the heat medium relay unit 3 and the first refrigerant flow switching device 11, and allows a heat source side refrigerant to flow only in a predetermined direction (direction from the heat medium relay unit 3 to the outdoor unit 1). The check valve 13*a* is provided in the refrigerant pipe 4 between the heat source side heat exchanger 12 and the heat medium relay unit 3, and allows a heat source side refrigerant to flow only in a predetermined direction (direction from the outdoor unit 1 to the heat medium relay unit 3). The check valve 13*b* is provided in the first connecting pipe 4*a* and causes a heat source side refrigerant discharged from the compressor 10 to circulate in the heat medium relay unit 3 during a heating operation. The check valve 13*c* is provided in the second connecting pipe 4*b* and causes a heat source side refrigerant returned from the heat medium relay unit 3 to circulate in the suction side of the compressor 10 during a heating operation.

In the outdoor unit 1, the first connecting pipe 4*a* connects a portion of the refrigerant pipe 4 positioned between the first refrigerant flow switching device 11 and the check valve 13*d* and a portion of the refrigerant pipe 4 positioned between the check valve 13*a* and the heat medium relay unit 3. In the outdoor unit 1, the second connecting pipe 4*b* connects a portion of the refrigerant pipe 4 positioned between the check valve 13*d* and the heat medium relay unit 3 and a portion of the refrigerant pipe 4 positioned between the heat source side heat exchanger 12 and the check valve 13*a*.

In a refrigeration cycle, a rise in the temperature of a refrigerant causes deterioration of a refrigerant and refrigerating machine oil which circulate within the circuit, and thus, the upper limit of the temperature is set. This upper limit temperature is generally 120 degrees centigrade. The highest temperature in a refrigeration cycle is a refrigerant temperature of a discharge side (discharge temperature) of the compressor 10. Accordingly, control may be performed so that the discharge temperature will not exceed 120 degrees centigrade. If R410A, for example, is used as a refrigerant, the discharge temperature does not usually reach 120 degrees centigrade under a normal operation. However, if R32 is used as a refrigerant, the discharge temperature becomes high due to its physical properties, and thus, it is necessary to provide means for reducing the discharge temperature in a refrigeration cycle.

Accordingly, in the outdoor unit 1, branch portions 27*a* and 27*b*, a backflow preventing device 20, expansion devices 14*a* and 14*b*, an intermediate-pressure detecting device 32, a discharged refrigerant temperature detecting device 37, a high-pressure detecting device 39, an injection pipe 4*c*, a branch pipe 4*d*, and a controller 50 are provided. As the compressor 10, the following low-pressure shell structure type is used. A compression chamber is provided within an air-tight container which is under a low-pressure refrigerant pressure atmosphere, and a low-pressure refrigerant within the air-tight container is sucked into the compression chamber and is compressed.

The branch pipe 4*d* connects the branch portion 27*a* provided on the downstream side of the check valves 13*a* and 13*b* and the branch portion 27*b* provided on the upstream side of the check valves 13*d* and 13*c*. In the branch pipe 4*d*, the backflow preventing device 20 and the expansion device 14*b* are sequentially provided in this order from the side of the branch portion 27*b*. The injection pipe 4*c* connects the branch pipe 4*d* provided between the backflow preventing device 20 and the expansion device 14*b* and an injection port (not shown) of the compressor 10. This injection port communicates with an opening formed in part of the compression chamber of the compressor 10. That is, the injection pipe 4*c* enables a refrigerant to be fed (injected) from the outside of the air-tight container of the compressor 10 into the inside of the compression chamber.

The branch portion 27*a* branches a refrigerant flowing via the check valve 13*a* or 13*b* into the refrigerant pipe 4 and the branch pipe 4*d*. The branch portion 27*b* branches a refrigerant returned from the heat medium relay unit 3 into the branch pipe 4*d* and into the check valve 13*b* or 13*c*. The backflow preventing device 20 is provided in the branch pipe 4*d* and allows a refrigerant to flow only in a predetermined direction (direction from the branch portion 27*b* to the branch portion 27*a*). The expansion device 14*a* is provided on the upstream side of the check valve 13*c* in the second connecting pipe 4*b*, and decompresses and expands a refrigerant flowing through the second connecting pipe 4*b*. The expansion device 14*b* is provided on the downstream side of the backflow preventing device 20 in the branch pipe 4*d*, and decompresses and expands a refrigerant flowing through the branch pipe 4*d*.

The intermediate-pressure detecting device 32 is provided on the upstream side of the check valve 13*d* and the expansion device 14*a* and on the downstream side of the branch portion 27*b*, and detects the pressure of a refrigerant flowing through the refrigerant pipe 4 at a position at which the intermediate-pressure detecting device 32 is installed. The discharged refrigerant temperature detecting device 37 is provided on the discharge side of the compressor 10 and detects the temperature of a refrigerant discharged from the compressor 10. The high-pressure detecting device 39 is provided on the discharge side of the compressor 10 and detects the pressure of a refrigerant discharged from the compressor 10. The controller 50 reduces the temperature or the degree of superheat (discharge superheat) of a refrigerant discharged from the compressor 10 as a result of feeding the refrigerant from the injection pipe 4*c* into the compression chamber. That is, the controller 50 controls the expansion valves 14*a* and 14*b* and so on, thereby making it possible to reduce the discharge temperature of the compressor 10 and to implement a safe operation.

A specific control operation performed by the controller 50 will be discussed in a description of individual operation modes, which will be given later. The controller 50 is constituted by a microcomputer and so on, and performs control on the basis of detection information obtained in various detecting devices or instructions from a remote controller. The controller 50 controls, not only the above-described actuators (expansion devices 14*a* and 14*b*), but also the driving frequency of the compressor 10, the rotation speed (including ON/OFF) of an air-sending device (not shown), the switching operation of the first refrigerant flow switching device 11, and so on, and then implements individual operation modes which will be described below.

The difference in the discharge temperature between when R410A is used as a refrigerant and when R32 is used as a refrigerant will be briefly discussed. In this case, it is assumed that the evaporating temperature in a refrigeration cycle is 0 degrees centigrade, the condensing temperature is 49 degrees centigrade, and the superheat (degree of superheat) of a refrigerant sucked into the compressor is 0 degrees centigrade.

If R410A is used as a refrigerant and adiabatic compression (isentropic compression) is performed, the discharge temperature of the compressor 10 is about 70 degrees centigrade due to the physical properties of R410A. On the other hand, if R32 is used as a refrigerant and adiabatic compression (isentropic compression) is performed, the discharge temperature of the compressor 10 is about 86 degrees centigrade due to the physical properties of R32. That is, when R32 is used as a refrigerant, the discharge temperature becomes higher by about 16 degrees centigrade than when R410A is used as a refrigerant.

In an actual operation, polytropic compression is performed in the compressor 10, which makes an operation less efficient than when adiabatic compression is performed, and thus, the discharge temperature becomes higher than the above-described value. When R410A is used as a refrigerant, it is not unusual that the compressor 10 is operated in the state in which the discharge temperature exceeds 100 degrees centigrade. Under the condition that the compressor 10 would be operated in the state in which the discharge temperature exceeds 104 degrees centigrade if R410A were used, in the case of the use of R32 as a refrigerant, the discharge temperature exceeds the upper limit temperature, that is, 120 degrees centigrade. It is thus necessary to reduce the discharge temperature.

It is now assumed that, as the compressor, a high-pressure shell structure type is used in which a suction refrigerant is directly sucked into a compression chamber, and the refrigerant is discharged from the compression chamber to an air-tight container around the compression chamber. In this case, by causing the suction refrigerant to be wetter than the saturation state and by sucking the refrigerant in a two phase state into the compression chamber, the discharge temperature can be reduced. However, if a low-pressure shell structure type is used as the compressor 10, even if a suction refrigerant is caused to be wetter, a liquid refrigerant is merely stored in the shell of the compressor 10, and a two-phase refrigerant is not sucked into the compression chamber. Accordingly, if a low-pressure shell structure type is used as the compressor 10 and if, for example, R32, which yields the increased discharge temperature, is used as a refrigerant, the following method may be taken in order to reduce the discharge temperature: a low-temperature refrigerant is injected from the outside of the compressor 10 into the compression chamber, which is in a course of performing compression, thereby reducing the temperature of the refrigerant. Then, the discharge temperature may be reduced by using the above-described method.

The amount of refrigerant to be injected into the compression chamber of the compressor 10 may be controlled so that the discharge temperature will be reduced to a target value, for example, 100 degrees centigrade, and the controlled target value may be changed in accordance with an outdoor air temperature. The amount of refrigerant to be injected into the compression chamber of the compressor 10 may be controlled such that a refrigerant is injected if the discharge temperature is likely to exceed a target value, for example, 110 degrees centigrade, and such that a refrigerant is not injected if the discharge temperature is not likely to exceed the target value. Alternatively, the amount of refrigerant to be injected into the compression chamber of the compressor 10 may be controlled so that the discharge temperature will be restricted within a target range, for example, from 80 to 100 degrees centigrade, and more specifically, the amount of refrigerant to be injected may be increased if the discharge temperature is likely to exceed the upper limit of the target range, and the amount of refrigerant to be injected may be decreased if the discharge temperature is likely to become lower than the lower limit of the target range.

Further, the amount of refrigerant to be injected into the compression chamber of the compressor 10 may be controlled as follows. The discharge superheat (discharge degree of superheat) may be calculated by using a high pressure detected by the high-pressure detecting device 39 and a discharge temperature detected by the discharged refrigerant temperature detecting device 37, and then, the amount of refrigerant to be injected into the compression chamber of the compressor 10 may be controlled so that the discharge superheat will become a target value, for example, 30 degrees centigrade. The controlled target value may be changed in accordance with an outdoor air temperature. Alternatively, the amount of refrigerant to be injected into the compression chamber of the compressor 10 may be controlled such that a refrigerant is injected if the discharge superheat is likely to exceed a target value, for example, 40 degrees centigrade, and such that a refrigerant is not injected if the discharge superheat is not likely to exceed the target value.

Alternatively, the amount of refrigerant to be injected into the compression chamber of the compressor 10 may be controlled so that the discharge superheat will be restricted within a target range, for example, from 10 to 40 degrees centigrade, and more specifically, the amount of refrigerant to be injected may be increased if the discharge superheat is likely to exceed the upper limit of the target range, and the amount of refrigerant to be injected may be decreased if the discharge superheat is likely to become lower than the lower limit of the target range.

A case in which R32 circulates within the refrigerant pipes 4 has been discussed above. However, the refrigerant is not restricted to R32. Any refrigerant may be used to achieve the above-stated advantage as long as the discharge temperature of the refrigerant becomes higher than that of conventional R410A, when the condensing temperature, the evaporating temperature, superheat (degree of superheat), subcooling (degree of subcooling), and the efficiency of the compressor are the same as those of R410A. In this case, with the configuration of Embodiment 1, the discharge temperature of such a refrigerant can be reduced, and advantages similar to those described above can be achieved. In particular, if a refrigerant is used in which the discharge temperature becomes higher than R410A by 3 degrees centigrade or higher, the effects are more enhanced.

Figure 3:
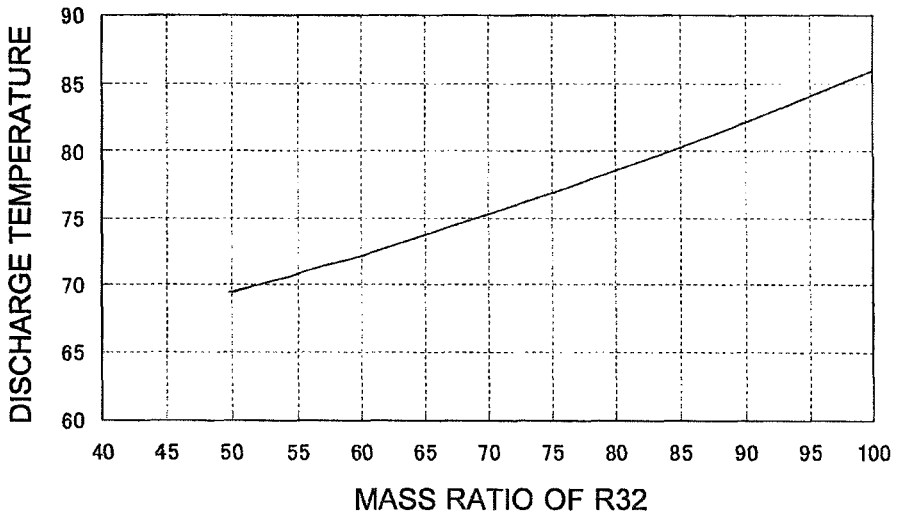
FIG. 3 is a graph illustrating the relationship between the mass ratio of R32 and the discharge temperature when a mixed refrigerant containing R32 is used.

FIG. 3 is a graph illustrating the relationship between the mass ratio of R32 and the discharge temperature when a mixed refrigerant (mixed refrigerant of R32 and HFO1234yf, which is a tetrafluoropropene refrigerant having a small global warming potential and having a chemical formula represented by $CF_3CF{=}CH_2$) is used. A description will be given, with reference to FIG. 3, of a change in the discharge temperature with respect to the mass ratio of R32 when this mixed refrigerant is used and when trial calculations were made to yield the discharge temperature by using a method similar to that described above.

It is seen from FIG. 3 that, when the mass ratio of R32 is 52%, the discharge temperature is about 70 degrees centigrade, which is substantially the same as the discharge temperature of R410A, and that, when the mass ratio of R32 is 62%, the discharge temperature is about 73 degrees centigrade, which is higher than that of R410A by 3 degrees centigrade. Accordingly, in the case of a mixed refrigerant of R32 and HFO1234yf, when a mixed refrigerant containing R32 having a mass ratio of 62% or higher is used, and the discharge temperature is reduced by performing injection, the effects are enhanced.

Moreover, a description will be given of a change in the discharge temperature with respect to the mass ratio of R32 when a mixed refrigerant of R32 and HFO1234ze, which is a tetrafluoropropene refrigerant having a small global warming potential and having a chemical formula represented by $CF_3CH{=}CHF$ is used and when trial calculations were made to yield the discharge temperature by using a method similar to that described above. In this case, it is understood that, when the mass ratio of R32 is 34%, the discharge temperature is about 70 degrees centigrade, which is substantially the same as the discharge temperature of R410A, and that, when the mass ratio of R32 is 43%, the discharge temperature is about 73 degrees centigrade, which is higher than that of R410A by 3 degrees centigrade. Accordingly, in the case of a mixed refrigerant of R32 and HFO1234ze, when a mixed refrigerant containing R32 having a mass ratio of 43% or higher is used, and then, the discharge temperature is reduced by performing injection, and the effects are enhanced.

These trial calculations were made by using REFPROP version 8.0 released by NIST (National Institute of Standards and Technology). Additionally, the type of mixed refrigerant is not restricted to the above-described type. The use of a mixed refrigerant containing a small amount of another refrigerant component does not greatly influence the discharge temperature, and advantages similar to those described above can be achieved. For example, a mixed refrigerant of R32, HFO1234yf, and a small amount of another refrigerant may be used. As stated above, the above-described calculations were made, assuming that adiabatic compression is performed. Actually, polytropic compression is performed, and thus, the temperature becomes higher than the above-described temperature, by several tens of degrees, for example, by 20 degrees centigrade or higher.

[Indoor Unit 2]

In each of the indoor units 2, a use side heat exchanger 26 is mounted. This use side heat exchanger 26 is connected to a heat medium flow control device 25 and a second heat medium flow switching device 23 of the heat medium relay unit 3 by using the pipes 5. This use side heat exchanger 26 performs heat exchange between air supplied from an air-sending device (not shown) and a heat medium and generates heating air or cooling air to be supplied to the indoor space 7.

FIG. 2 shows a case in which four indoor units 2 are connected to the heat medium relay unit 3 by way of example. The indoor units 2 are shown as indoor units 2*a*, 2*b*, 2*c*, and 2*d* from the bottom side of the plane of the drawing. In association with the indoor units 2*a* through 2*d*, the use side heat exchangers 26 are also shown as use side heat exchangers 26*a*, 26*b*, 26*c*, and 26*d*, respectively, from the bottom side of the plane of the drawing. As in FIG. 1, the number of indoor units 2 is not restricted to four as shown in FIG. 2.

[Heat Medium Relay Unit 3]

In the heat medium relay unit 3, two heat exchangers 15 related to heat medium, two expansion devices 16, two opening/closing devices 17, two second refrigerant flow switching devices 18, two pumps 21, four first heat medium flow switching devices 22, four second heat medium flow switching devices 23, and four heat medium flow control devices 25 are mounted.

The two heat exchangers 15 related to heat medium (two heat exchangers 15*a* and 15*b* related to heat medium) serve as condensers (radiators) or evaporators, and perform heat exchange between a heat source side refrigerant and a heat medium and transmit cooling energy or heating energy generated in the outdoor unit 1 and stored in the heat source side refrigerant to the heat medium. The heat exchanger 15*a* related to heat medium is provided between the expansion device 16*a* and the second refrigerant flow switching device 18*a* in the refrigerant circuit A, and serves to cool a heat medium during a cooling and heating mixed operation mode. The heat exchanger 15*b* related to heat medium is provided between the expansion device 16*b* and the second refrigerant flow switching device 18*b* in the refrigerant circuit A, and serves to heat a heat medium during a cooling and heating mixed operation mode.

The two expansion devices 16 (expansion devices 16*a* and 16*b*) may serve as pressure reducing valves or expansion valves, and decompress and expand a heat source side refrigerant. The expansion device 16*a* is provided on the upstream side of the heat exchanger 15*a* related to heat medium in the flow of a heat source side refrigerant during a cooling operation. The expansion device 16*b* is provided on the upstream side of the heat exchanger 15*b* related to heat medium in the flow of a heat source side refrigerant during a cooling operation. As the two expansion devices 16, expansion valves which can perform control so that the opening degree (aperture area) may be variable, such as electronic expansion valves, may be used.

The two opening/closing devices 17 (opening/closing devices 17*a* and 17*b*) are constituted by two-port valves, and open and close the refrigerant pipes 4. The opening/closing device 17*a* is provided at the inlet side of the refrigerant pipe 4 into which a heat source side refrigerant enters. The opening/closing device 17*b* is provided in a pipe (bypass pipe 24) connecting the inlet side and the outlet side of the refrigerant pipe 4 into and from which a heat source side refrigerant enters and ejects. As the opening/closing devices 17, any devices may be used as long as they can open and close the refrigerant pipes 4. For example, devices which can perform control so that the opening degree (aperture area) may be variable, such as electronic expansion valves, may be used.

The two second refrigerant flow switching devices 18 (second refrigerant flow switching devices 18*a* and 18*b*) are constituted by four-way valves, and switch the flow of a heat source side refrigerant so that the heat exchangers 15 related to heat medium may serve as condensers or evaporators in accordance with the operation mode. The second refrigerant flow switching device 18*a* is provided on the downstream side of the heat exchanger 15*a* related to heat medium in the flow of a heat source side refrigerant during a cooling operation. The second refrigerant flow switching device 18*b* is provided on the downstream side of the heat exchanger 15*b* related to heat medium in the flow of a heat source side refrigerant during a cooling only operation.

The two pumps 21 (pumps 21*a* and 21*b*) serve to pump a heat medium which passes through the pipes 5 to the heat medium circuit B and to circulate the heat medium in the heat medium circuit B. The pump 21*a* is provided in the pipe 5 between the heat exchanger 15*a* related to heat medium and the second heat medium flow switching device 23. The pump 21*b* is provided in the pipe 5 between the heat exchanger 15*b* related to heat medium and the second heat medium flow switching device 23. As the two pumps 21, pumps which can control the capacity may be used, and the flow rate of the pumps 21 may be set to be adjustable depending on the load in the indoor units 2.

The four first heat medium flow switching devices 22 (first heat medium flow switching devices 22*a* through 22*d*) are constituted by, for example, three-port valves, and switch the flow channel of a heat medium. The same number (four in this case) of first heat medium flow switching devices 22 as the number of indoor units 2 are provided. In each of the first heat medium flow switching devices 22, one of the three ports is connected to the heat exchanger 15*a* related to heat medium, one of the three ports is connected to the heat exchanger 15*b* related to heat medium, and one of the three ports is connected to the heat medium flow control device 25. Each of the first heat medium flow switching devices 22 is connected to the outlet side of the heat medium flow channel of the associated use side heat exchanger 26. In association with the indoor units 2, the first heat medium flow switching devices 22 are shown as the first heat medium flow switching devices 22*a*, 22*b*, 22*c*, and 22*d* from the bottom side of the plane of the drawing. The switching operation of the heat medium flow channel includes, not only complete switching from one to the other side, but also partial switching from one to the other side.

The four second heat medium flow switching devices 23 (second heat medium flow switching devices 23*a* through 23*d*) are constituted by, for example, three-port valves, and switch the flow channel of a heat medium. The same number (four in this case) of second heat medium flow switching devices 23 as the number of indoor units 2 are provided. In each of the second heat medium flow switching devices 23, one of the three ports is connected to the heat exchanger 15*a* related to heat medium, one of the three ports is connected to the heat exchanger 15*b* related to heat medium, and one of the three ports is connected to the use side heat exchanger 26. Each of the second heat medium flow switching devices 23 is connected to the inlet side of the heat medium flow channel of the associated use side heat exchanger 26. In association with the indoor units 2, the second heat medium flow switching devices 23 are shown as the second heat medium flow switching devices 23*a*, 23*b*, 23*c*, and 23*d* from the bottom side of the plane of the drawing. The switching operation of the heat medium flow channel includes, not only complete switching from one to the other side, but also partial switching from one to the other side.

The four heat medium flow control devices 25 (heat medium flow control devices 25*a* through 25*d*) are constituted by, for example, two-port valves which can control the aperture area, and control the flow rate of a heat medium flowing through the pipes 5. The same number (four in this case) of heat medium flow control devices 25 as the number of indoor units 2 is provided. In each of the heat medium flow control devices 25, one of the two ports is connected to the use side heat exchanger 26, and the other one of the two ports is connected to the first heat medium flow switching device 22. Each of the heat medium flow control devices 25 is provided at the outlet side of the heat medium flow channel of the associated use side heat exchanger 26. That is, each of the heat medium flow control devices 25 controls the amount of heat medium flowing into the associated indoor unit 2 on the basis of the temperatures of a heat medium flowing into and out of the indoor unit 2, thereby making it possible to provide the optimal amount of heat medium to the indoor unit 2 in accordance with an indoor load.

In association with the indoor units 2, the heat medium flow control devices 25 are shown as the heat medium flow control devices 25*a*, 25*b*, 25*c*, and 25*d* from the bottom side of the plane of the drawing. Each of the heat medium flow control devices 25 may be provided at the inlet side of the heat medium flow channel of the associated use side heat exchanger 26. Moreover, each of the heat medium flow control devices 25 may be provided at the inlet side of the heat medium flow channel of the associated use side heat exchanger 26, between the second heat medium flow switching device 23 and the use side heat exchanger 26. Additionally, if a load is not necessary in the indoor unit 2, for example, when the indoor unit 2 is turned OFF or when the thermostat is turned OFF, the heat medium flow control device 25 may be set in the full closed position, thereby making it possible to stop supplying a heat medium to the indoor unit 2.

In the heat medium relay unit 3, various detecting devices (two first temperature sensors 31, four second temperature sensors 34, four third temperature sensors 35, and two pressure sensors 36) are provided. Items of information (temperature information and pressure information) obtained in these detecting devices are supplied to a controller (for example, the controller 50) that centrally controls the operation of the air-conditioning apparatus 100, and are utilized for controlling the driving frequency of the compressor 10, the rotation speed of an air-sending device (not shown), the switching operation of the first refrigerant flow switching device 11, the driving frequency of the pumps 21, the switching operation of the second refrigerant flow switching devices 18, the switching of the flow channel of a heat medium, and so on. The state in which the controller 50 is mounted in the outdoor unit 1 is shown by way of example. However, the position of the controller 50 is not restricted to this state, and the controller 50 may be mounted in the heat medium relay unit 3 or the indoor unit 2. Alternatively, the controller 50 may be mounted in each of the units such that the controllers 50 can communicate with one another.

Each of the two first temperature sensors 31 (first temperature sensors 31*a* and 31*b*) detects the temperature of a heat medium flowing out of the heat exchanger 15 related to heat medium, that is, the temperature of a heat medium at the outlet of the heat exchanger 15 related to heat medium. The first temperature sensors 31 may be constituted by, for example, thermistors. The first temperature sensor 31*a* is provided in the pipe 5 at the inlet side of the pump 21*a*. The first temperature sensor 31*b* is provided in the pipe 5 at the inlet side of the pump 21*b*.

Each of the four second temperature sensors 34 (second temperature sensors 34*a* through 34*d*) is provided between the associated first heat medium flow switching device 22 and the associated heat medium flow control device 25, and detects the temperature of a heat medium flowing out of the use side heat exchangers 26. The second temperature sensors 34 may be constituted by, for example, thermistors. The same number (four in this case) of second temperature sensors 34 as the number of indoor units 2 are provided. In association with the indoor units 2, the second temperature sensors 34 are shown as the second temperature sensors 34*a*, 34*b*, 34*c*, and 34*d* from the bottom side of the plane of the drawing.

The four third temperature sensors 35 (third temperature sensors 35*a* through 35*d*) are provided at the inlet side or the outlet side of the heat exchangers 15 related to heat medium into and from which a heat source side refrigerant enters and ejects, and detect the temperature of a heat source side refrigerant flowing into or out of the heat exchangers 15 related to heat medium. The third temperature sensors 35 may be constituted by, for example, thermistors. The third temperature sensor 35*a* is provided between the heat exchanger 15*a* related to heat medium and the second refrigerant flow switching device 18*a*. The third temperature sensor 35*b* is provided between the heat exchanger 15*a* related to heat medium and the expansion device 16*a*. The third temperature sensor 35*c* is provided between the heat exchanger 15*b* related to heat medium and the second refrigerant flow switching device 18*b*. The third temperature sensor 35*d* is provided between the heat exchanger 15*b* related to heat medium and the expansion device 16*b*.

The pressure sensor 36*b* is provided between the heat exchanger 15*b* related to heat medium and the expansion device 16*b*, in a manner similar to the installation position of the third temperature sensor 35*d*. The pressure sensor 36*b* detects the pressure of a heat source side refrigerant flowing between the heat exchanger 15*b* related to heat medium and the expansion device 16*b*. The pressure sensor 36*a* is provided between the heat exchanger 15*a* related to heat medium and the second refrigerant flow switching device 18*a*, in a manner similar to the installation position of the third temperature sensor 35*a*. The pressure sensor 36*a* detects the pressure of a heat source side refrigerant flowing between the heat exchanger 15*a* related to heat medium and the second refrigerant flow switching device 18*a*.

A controller (for example, the controller 50 provided in the outdoor unit 1) is constituted by a microcomputer and so on. The controller controls, on the basis of detection information obtained in various detecting devices or instructions from a remote controller, the driving of the pumps 21, the opening degree of the expansion valves 16, the opening/closing operation of the opening/closing devices 17, the switching operation of the second refrigerant flow switching devices 18, the switching operation of the first heat medium flow switching devices 22, the switching operation of the second heat medium flow switching devices 23, the opening degree of the heat medium flow control device 25, and so on, and then implements individual operation modes, which will be described below. The controller may be provided only in one of the outdoor unit 1 and the heat medium relay unit 3.

The pipes 5 which allow a heat medium to pass therethrough are constituted by pipes 5 connected to the heat exchangers 15*a* related to heat medium and pipes 5 connected to heat exchangers 15*b* related to heat medium. The pipes 5 branch off (in this case, in four directions) in accordance with the number of indoor units 2 connected to the heat medium relay unit 3. The pipes 5 join at the first heat medium flow switching device 22 and the second heat medium flow switching device 23. By controlling the first heat medium flow switching device 22 and the second heat medium flow switching device 23, a determination is made as to whether a heat medium from the heat exchanger 15*a* related to heat medium or from the heat exchanger 15*b* related to heat medium will flow into the use side heat exchanger 26.

In the air-conditioning apparatus 100, the compressor 10, the first refrigerant flow switching device 11, the heat source side heat exchanger 12, the opening/closing devices 17, the second refrigerant flow switching devices 18, the refrigerant flow channel of the heat exchanger 15*a* related to heat medium, the expansion devices 16, and the accumulator 19 are connected to each other by using the refrigerant pipes 4, thereby forming the refrigerant circuit A. The heat medium flow channel of the heat exchanger 15*a* related to heat medium, the pumps 21, the first heat medium flow switching devices 22, the heat medium flow control devices 25, the use side heat exchangers 26, and the second heat medium flow switching devices 23 are connected to one another by using the pipes 5, thereby forming the heat medium circuit B. That is, the plurality of use side heat exchangers 26 are connected in parallel with each of the heat exchangers 15 related to heat medium, thereby allowing the heat medium circuit B to have a plurality of channels.

In the air-conditioning apparatus 100, the outdoor unit 1 and the heat medium relay unit 3 are connected to each other via the heat exchangers 15*a* and 15*b* related to heat medium provided in the heat medium relay unit 3, and the heat medium relay unit 3 and the indoor units 2 are also connected to each other via the heat exchangers 15*a* and 15*b* related to heat medium. That is, in the air-conditioning apparatus 100, heat exchange is performed in the heat exchangers 15*a* and 15*b* related to heat medium between a heat source side refrigerant circulating within the refrigerant circuit A and a heat medium circulating within the heat medium circuit B.

[Operation Modes]

Individual operation modes performed by the air-conditioning apparatus 100 will be described below. This air-conditioning apparatus 100 is capable of performing, on the basis of an instruction from each indoor unit 2, a cooling operation or a heating operation in the indoor unit 2. That is, the air-conditioning apparatus 100 is capable of performing the same operation in all the indoor units 2 or of performing different operations in the individual indoor units 2.

Operation modes performed by the air-conditioning apparatus 100 are a cooling only operation in which all the driven indoor units 2 perform a cooling operation, a heating only operation in which all the driven indoor units 2 perform a heating operation, and a cooling and heating mixed operation mode. The cooling and heating mixed operation mode includes a cooling main operation mode in which a cooling load is greater than a heating load, and a heating main operation mode in which a heating load is greater than a cooling load. The individual operation modes will be described below, together with a description of the flow of a heating source side refrigerant and the flow of a heat medium.

[Cooling Only Operation Mode]

Figure 4:
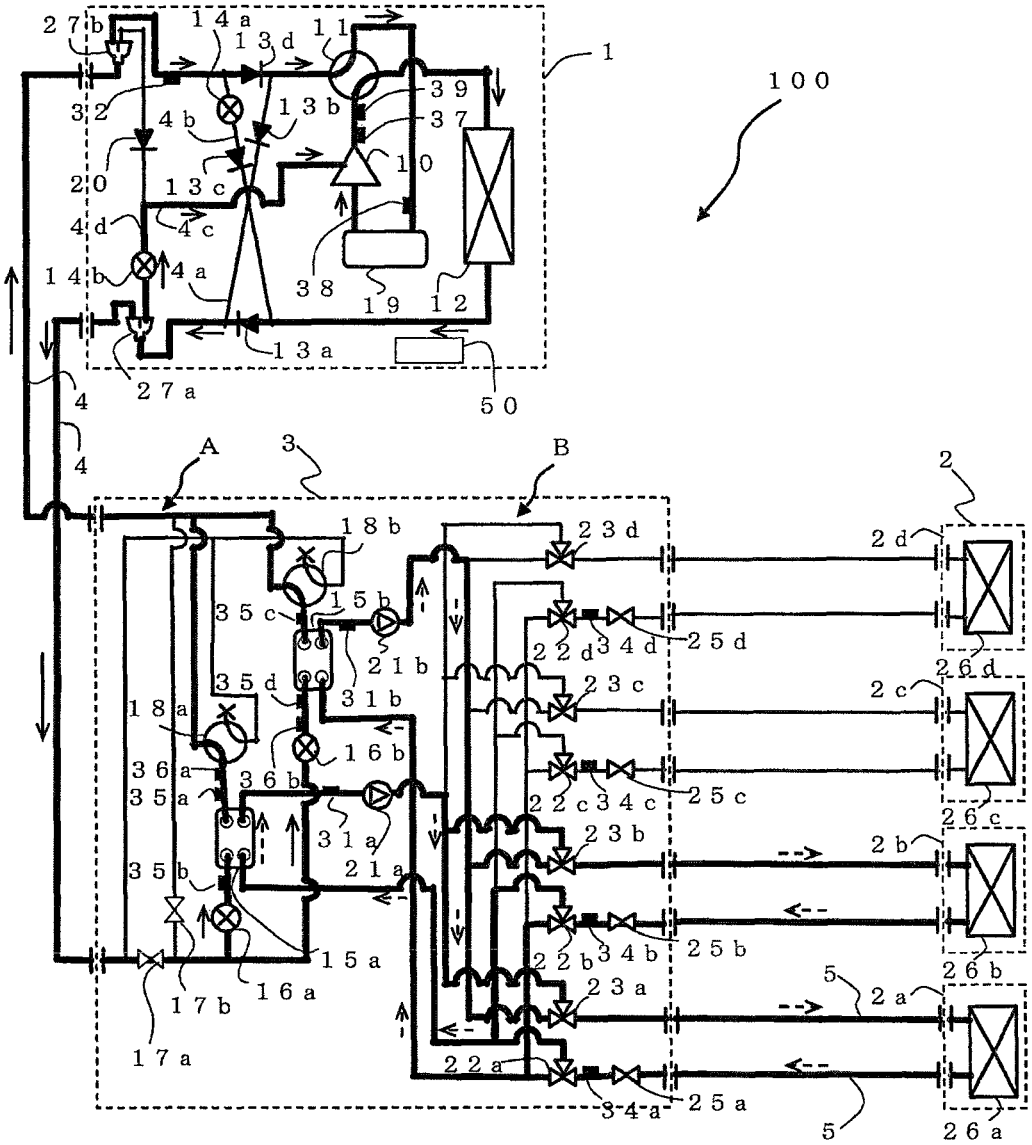
FIG. 4 is a refrigerant circuit diagram illustrating the flow of a refrigerant in a cooling only operation mode performed by the air-conditioning apparatus according to Embodiment 1 of the present invention.

FIG. 4 is a refrigerant circuit diagram illustrating the flow of a refrigerant in the cooling only operation mode performed by the air-conditioning apparatus 100. The cooling only operation mode will be discussed with reference to FIG. 4 by taking, as an example, a case in which a cooling load is generated only in the use side heat exchangers 26*a* and 26*b*. In FIG. 4, the pipes indicated by the thick lines are pipes through which refrigerants (a heat source side refrigerant and a heat medium) flow. In FIG. 4, the direction in which a heat source side refrigerant flows is indicated by the solid arrows, and the direction in which a heat medium flows is indicated by the dotted arrows.

In the case of the cooling only operation mode shown in FIG. 4, in the outdoor unit 1, the first refrigerant flow switching device 11 is switched so that a heat source side refrigerant discharged from the compressor 10 will flow into the heat source side heat exchanger 12. In the heat medium relay unit 3, the pumps 21*a* and 21*b* are driven to open the heat medium flow control devices 25*a* and 25*b* and to set the heat medium flow control devices 25*c* and 25*d* in the full closed state, thereby allowing a heat medium to circulate between the heat exchanger 15*a* related to heat medium and the use side heat exchangers 26*a* and 26*b* and between the heat exchanger 15*b* related to heat medium and the use side heat exchangers 26*a* and 26*b*.

A description will first be given of the flow of a heat source side refrigerant in the refrigerant circuit A.

A low-temperature low-pressure refrigerant is compressed by the compressor 10 and is discharged as a high-temperature high-pressure gas refrigerant. The high-temperature high-pressure gas refrigerant discharged from the compressor 10 flows into the heat source side heat exchanger 12 via the first refrigerant flow switching device 11. Then, in the heat source side heat exchanger 12, the high-temperature high-pressure gas refrigerant is condensed and liquefied while transferring heat to outdoor air and is transformed into a high-pressure liquid refrigerant. The high-pressure liquid refrigerant flowing out of the heat source side heat exchanger 12 passes through the check valve 13*a* and partially flows out of the outdoor unit 1 via the branch portion 27*a* and flows into the heat medium relay unit 3 via the refrigerant pipe 4. The high-pressure liquid refrigerant flowing into the heat medium relay unit 3 is branched toward the expansion devices 16*a* and 16*b* after passing through the opening/closing device 17*a*. The high-pressure liquid refrigerant is then expanded to a low-temperature low-pressure two-phase refrigerant in the expansion devices 16*a* and 16*b*.

This two-phase refrigerant flows into each of the heat exchangers 15*a* and 15*b* related to heat medium, which serve as evaporators, and absorbs heat from a heat medium circulating in the heat medium circuit B. In this manner, the two-phase refrigerant is transformed into a low-temperature low-pressure gas refrigerant while cooling the heat medium. The gas refrigerant flowing out of the heat exchangers 15*a* and 15*b* related to heat medium flows out of the heat medium relay unit 3 via the second refrigerant flow switching devices 18*a* and 18*b*, respectively, and again flows into the outdoor unit 1 via the refrigerant pipe 4. The refrigerant flowing into the outdoor unit 1 passes through the check value 13*d* via the branch portion 27*b* and is again sucked into the compressor 10 via the first refrigerant flow switching device 11 and the accumulator 19.

In this case, the opening degree (aperture area) of the expansion device 16*a* is controlled so that the superheat (degree of superheat) obtained as a difference between the temperature detected by the third temperature sensor 35*a* and the temperature detected by the third temperature sensor 35*b* will become constant. Similarly, the opening degree (aperture area) of the expansion device 16*b* is controlled so that the superheat obtained as a difference between the temperature detected by the third temperature sensor 35*c* and the temperature detected by the third temperature sensor 35*d* will become constant. The opening/closing device 17*a* is opened, and the opening/closing device 17*b* is closed.

Figure 5:
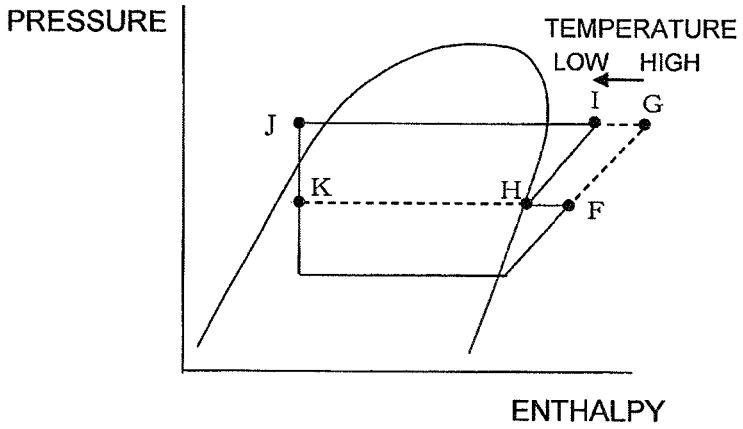
FIG. 5 is a p-h diagram illustrating a state transition of a heat source side refrigerant during a cooling only operation mode performed by the air-conditioning apparatus according to Embodiment 1 of the present invention.

If R32 is used as the heat source side refrigerant, the discharge temperature of the compressor 10 may become higher, and thus, by using an injection circuit, the discharge temperature is decreased. The operation to be performed in this case will be discussed below with reference to FIGS. 4 and 5. FIG. 5 is a p-h diagram (pressure-enthalpy diagram) illustrating a state transition of a heat source side refrigerant during the cooling only operation mode. In FIG. 5, the vertical axis indicates the pressure, and the horizontal axis indicates enthalpy.

In the compressor 10, a low-temperature low-pressure gas refrigerant sucked from the suction inlet of the compressor 10 is fed into an air-tight container, and the low-temperature low-pressure gas refrigerant filling the air-tight container is sucked into a compression chamber (not shown). As the compression chamber is being rotated at 0 to 360 degrees by a motor (not shown), the internal capacity of the compression chamber decreases. As the internal capacity of the compression chamber is being decreased, the refrigerant sucked into the compression chamber is compressed so as to increase the pressure and the temperature thereof. When the rotation angle of the motor reaches a certain angle, an opening (formed in part of the compression chamber) is opened (this state is indicated by point F in FIG. 5), and the inside of the compression chamber and the injection pipe 4*c* positioned outside the compressor 10 communicate with each other.

In the cooling only operation mode, the refrigerant compressed in the compressor 10 is condensed and liquefied in the heat source side heat exchanger 12 and is transformed into a high-pressure liquid refrigerant (indicated by point J in FIG. 5). The high-pressure liquid refrigerant then reaches the branch portion 27*a* via the check valve 13*a*. This high-pressure liquid refrigerant is branched at the branch portion 27*a*, and part of the refrigerant is decompressed into a low-temperature intermediate-pressure two-phase refrigerant in the expansion device 14*b*. The low-temperature intermediate-pressure two-phase refrigerant then flows into the injection pipe 4*c* via the branch pipe 4*d*. The refrigerant flowing into the injection pipe 4*c* flows into the compression chamber through the opening provided in the compression chamber of the compressor 10. In this case, due to a pressure drop occurring at the opening of the compression chamber (pressure drop occurring because of a sudden expansion or reduction of the flow of a refrigerant which flows through a narrow flow channel), the refrigerant flows into the compression chamber of the compressor 10 as a low-temperature intermediate-pressure two-phase refrigerant with a slightly reduced pressure (indicated by point K in FIG. 5). Within the compression chamber, the low-temperature intermediate-pressure two-phase refrigerant (indicated by point K in FIG. 5) is mixed with the intermediate-pressure gas refrigerant (indicated by point F in FIG. 5), thereby reducing the temperature of the refrigerant (indicated by point H in FIG. 5).

With this operation, the discharge temperature of the refrigerant discharged from the compressor 10 is reduced (indicated by point I in FIG. 5). The discharge temperature of the compressor 10 when such an injecting operation is not performed is indicated by point G in FIG. 5, and it is understood that the discharge temperature is reduced from point G to point I because the injecting operation has been performed.

In the cooling only operation mode, by changing the opening degree of the expansion device 14*b*, the pressure of a refrigerant positioned on the upstream side of the expansion device 14*b* is changed, thereby controlling the amount of refrigerant to be injected into the compression chamber of the compressor 10. As a result, the discharge temperature or the discharge superheat of the compressor 10 can be controlled.

In this case, a refrigerant flowing through a flow channel from the expansion device 14*b* to the backflow preventing device 20 in the branch pipe 4*d* is an intermediate-pressure refrigerant, and a refrigerant returning from the heat medium relay unit 3 to the outdoor unit 1 via the refrigerant pipe 4 and reaching the branch portion 27*b* is a low-pressure refrigerant. The backflow preventing device 20 prevents a refrigerant flowing through the branch pipe 4*d* from flowing into the branch portion 27*b*. Due to the function of the backflow preventing device 20, the intermediate-pressure refrigerant flowing through the branch pipe 4*d* is prevented from being mixed with the low-pressure refrigerant flowing at the branch portion 27*b*.

The backflow preventing device 20 may be a check valve. Alternatively, the backflow preventing device 20 may be a valve in which the opened/closed states can be switched, such as a solenoid valve, or a valve in which the aperture area is changeable and the opened/closed states of a flow channel can be switched, such as an electronic expansion valve. A refrigerant does not flow through the expansion device 14*a*, and thus, the opening degree of the expansion device 14*a* may be set as desired. As the expansion device 14*b*, a valve whose aperture area can be changed, such as an electronic expansion valve, is used, and the aperture area is controlled so that the discharge temperature of the compressor 10 detected by the discharged refrigerant temperature detecting device 37 will not become excessively high. The aperture area of the expansion device 14*b* may be controlled in the following manner. When the discharge temperature exceeds a certain value, for example, 110 degrees centigrade, the expansion device 14*b* may be opened by a certain opening degree, for example, every 10 pulses. The opening degree may be controlled so that the discharge temperature will be a target value, for example, 100 degrees centigrade. As the expansion device 14*b*, a capillary tube may be used, and a refrigerant may be injected by an amount in accordance with a pressure difference.

A description will now be given of the flow of a heat medium in the heat medium circuit B.

In the cooling only operation mode, cooling energy of a heat source side refrigerant is transmitted to a heat medium in both of the heat exchangers 15*a* and 15*b* related to heat medium, and the cooled heat medium circulates within the pipes 5 by using the pumps 21*a* and 21*b*. The heat medium pressurized in the pumps 21*a* and 21*b* flows out of the pumps 21*a* and 21*b* into the use side heat exchangers 26*a* and 26*b* via the second heat medium flow switching devise 23*a* and 23*b*, respectively. Then, the heat medium absorbs heat from indoor air in the use side heat exchangers 26*a* and 26*b*, thereby cooling the indoor space 7.

Then, the heat medium flows out of each of the use side heat exchangers 26*a* and 26*b* and flows into the corresponding one of heat medium flow control devices 25*a* and 25*b*. In this case, due to the working of the heat medium flow control devices 25*a* and 25*b*, the flow rate of the heat medium is set to be a flow rate which is necessary to compensate for an air conditioning load required indoors, and then, the heat medium flows into the use side heat exchangers 26*a* and 26*b*. The heat medium flowing out of each of the heat medium flow control devices 25*a* and 25*b* passes through corresponding one of the first heat medium flow switching devices 22*a* and 22*b*, flows into the heat exchangers 15*a* and 15*b* related to heat medium, and are then sucked into the pumps 21*a* and 21*b* again.

In the pipes 5 connected to the use side heat exchanger 26, a heat medium flows in the direction from the second heat medium flow switching device 23 to the first heat medium flow switching device 22 via the heat medium flow control device 25. An air conditioning load required in the indoor space 7 can be compensated for by performing control so that the difference between the temperature detected by the first temperature sensor 31*a* or 31*b* and the temperature detected by the second temperature sensor 34 will be maintained at a target value. As the temperature at the outlet of the heat exchanger 15 related to heat medium, either of the temperature of the first temperature sensor 31*a* or that of the first temperature sensor 31*b* may be used, or the average of these temperatures may be used. In this case, the opening degrees of the first heat medium flow switching device 22 and the second heat medium flow switching device 23 are set to be an intermediate degree so that it is possible to secure flow channels through which a heat medium flows both to the heat exchangers 15*a* and 15*b* related to heat medium.

When the cooling only operation mode is performed, it is not necessary to allow a heat medium to flow into use side heat exchangers 26 having no heating load (including a case in which a thermostat is OFF). Accordingly, flow channels to such use side heat exchangers 26 are closed by using the associated heat medium flow control devices 25, thereby preventing a heat medium from flowing into such use side heat exchangers 26. In FIG. 4, since the use side heat exchangers 26*a* and 26*b* have a heating load, a heat medium flows into the use side heat exchangers 26*a* and 26*b*. However, the use side heat exchangers 26*c* and 26*d* do not have a heating load, and thus, the associated heat medium flow control devices 25*c* and 25*d* are set in the full closed position. When a heating load is generated in the use side heat exchanger 26*c* or 26*d*, the heat medium flow control device 25*c* or 25*d* is opened, thereby allowing a heat medium to circulate.

[Heating Only Operation Mode]

Figure 6:
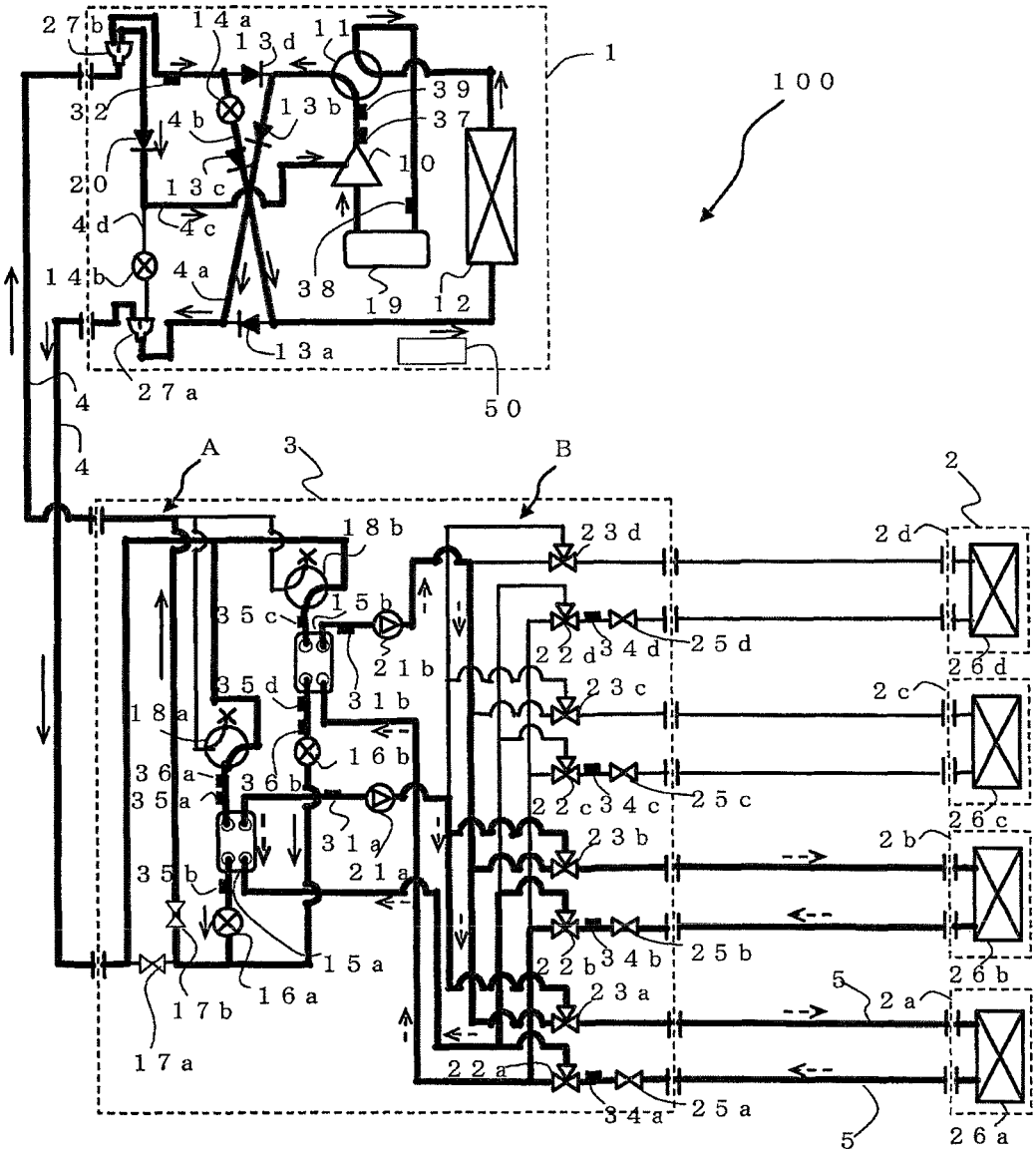
FIG. 6 is a refrigerant circuit diagram illustrating the flow of a refrigerant in a heating only operation mode performed by the air-conditioning apparatus according to Embodiment 1 of the present invention.

FIG. 6 is a refrigerant circuit diagram illustrating the flow of a refrigerant in the heating only operation mode performed by the air-conditioning apparatus 100. The heating only operation mode will be discussed with reference to FIG. 6 by taking, as an example, a case in which a heating load is generated only in the use side heat exchangers 26*a* and 26*b*. In FIG. 6, the pipes indicated by the thick lines are pipes through which refrigerants (a heat source side refrigerant and a heat medium) flow. In FIG. 6, the direction in which a heat source side refrigerant flows is indicated by the solid arrows, and the direction in which a heat medium flows is indicated by the dotted arrows.

In the case of the heating only operation mode shown in FIG. 6, in the outdoor unit 1, the first refrigerant flow switching device 11 is switched so that a heat source side refrigerant discharged from the compressor 10 will flow into the heat medium relay unit 3 without passing through the heat source side heat exchanger 12. In the heat medium relay unit 3, the pumps 21*a* and 21*b* are driven to open the heat medium flow control devices 25*a* and 25*b* and to set the heat medium flow control devices 25*c* and 25*d* in the full closed state, thereby allowing a heat medium to circulate between each of the heat exchangers 15*a* and 15*b* related to heat medium and the use side heat exchangers 26*a* and 26*b*.

A description will first be given of the flow of a heat source side refrigerant in the refrigerant circuit A.

A low-temperature low-pressure refrigerant is compressed by the compressor 10 and is discharged as a high-temperature high-pressure gas refrigerant. The high-temperature high-pressure gas refrigerant discharged from the compressor 10 passes through the first refrigerant flow switching device 11 and the first connecting pipe 4*a*, passes through the check value 13*b* and the branch portion 27*a*, and flows out of the outdoor unit 1. The high-temperature high-pressure gas refrigerant flowing out of the outdoor unit 1 flows into the heat medium relay unit 3 via the refrigerant pipe 4. The high-temperature high-pressure gas refrigerant flowing into the heat medium relay unit 3 is branched, passes through the second refrigerant flow switching devices 18*a* and 18*b*, and then flows into each of the heat exchangers 15*a* and 15*b* related to heat medium.

This high-temperature high-pressure gas refrigerant flowing into the heat exchangers 15*a* and 15*b* related to heat medium is condensed and liquefied while transferring heat to a heat medium circulating in the heat medium circuit B, and is transformed into a high-pressure liquid refrigerant. The liquid refrigerant flowing out of the heat exchangers 15*a* and 15*b* related to heat medium is expanded in the expansion devices 16*a* and 16*b* into an intermediate-temperature intermediate-pressure two-phase refrigerant. This two-phase refrigerant passes through the opening/closing device 17*b*, flows out of the heat medium relay unit 3, and again flows into the outdoor unit 1 via the refrigerant pipe 4. The refrigerant flowing into the outdoor unit 1 partially flows into the second connecting pipe 4*b* via the branch portion 27*b* and passes through the expansion device 14*a*. At this time, the refrigerant flow is regulated in the expansion device 14*a* and is transformed into a low-temperature low-pressure two-phase refrigerant. This two-phase refrigerant passes through the check valve 13*c* and flows into the heat source side heat exchanger 12, which serves as an evaporator.

Then, the refrigerant flowing into the heat source side heat exchanger 12 absorbs heat from outdoor air in the heat source side heat exchanger 12 and is transformed into a low-temperature low-pressure gas refrigerant. The low-temperature low-pressure gas refrigerant flowing out of the heat source side heat exchanger 12 is again sucked into the compressor 10 via the first refrigerant flow switching device 11 and the accumulator 19.

In this case, the opening degree of the expansion device 16*a* is controlled so that subcooling (degree of subcooling) obtained as a difference between the saturation temperature converted from the pressure detected by the pressure sensor 36 and the temperature detected by the third temperature sensor 35*b* will become constant. Similarly, the opening degree of the expansion device 16*b* is controlled so that subcooling (degree of subcooling) obtained as a difference between the saturation temperature converted from the pressure detected by the pressure sensor 36 and the temperature detected by the third temperature sensor 35*d* will become constant. The opening/closing device 17*a* is closed, and the opening/closing device 17*b* is opened. If the temperature of the intermediate position of the heat exchanger 15 related to heat medium can be measured, it may be used instead of the pressure detected by the pressure sensor 36. Then, the system can be constructed at low cost.

Figure 7:
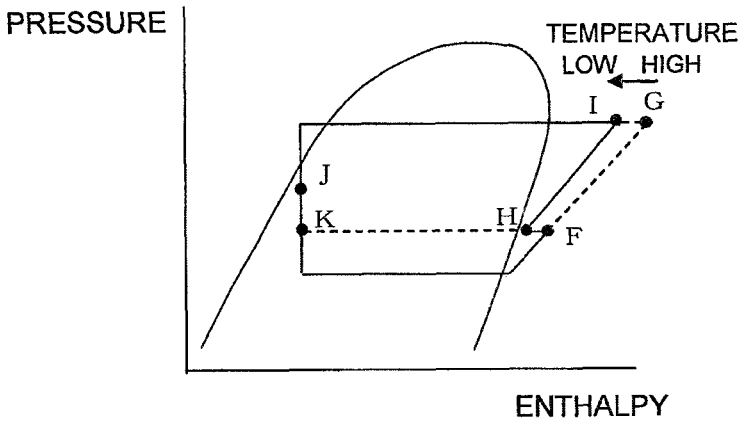
FIG. 7 is a p-h diagram illustrating a state transition of a heat source side refrigerant during a heating only operation mode performed by the air-conditioning apparatus according to Embodiment 1 of the present invention.

If R32 is used as the heat source side refrigerant, the discharge temperature of the compressor 10 may become higher, and thus, by using an injection circuit, the discharge temperature is decreased. The operation to be performed in this case will be discussed below with reference to FIGS. 6 and 7. FIG. 7 is a p-h diagram (pressure-enthalpy diagram) illustrating a state transition of a heat source side refrigerant during the heating only operation mode. In FIG. 7, the vertical axis indicates the pressure, and the horizontal axis indicates enthalpy.

In the compressor 10, a low-temperature low-pressure gas refrigerant sucked from the suction inlet of the compressor 10 is fed into an air-tight container, and the low-temperature low-pressure gas refrigerant filling the air-tight container is sucked into a compression chamber (not shown). As the compression chamber is being rotated at 0 to 360 degrees by a motor (not shown), the internal capacity of the compression chamber decreases. As the internal capacity of the compression chamber decreases, the refrigerant sucked into the compression chamber is compressed so as to increase the pressure and the temperature thereof. When the rotation angle of the motor reaches a certain angle, an opening (formed in part of the compression chamber) is opened (this state is indicated by point F in FIG. 7), and the inside of the compression chamber and the injection pipe 4*c* positioned outside the compressor 10 communicate with each other.

In the heating only operation mode, the refrigerant returning from the heat medium relay unit 3 to the outdoor unit 1 via the refrigerant pipe 4 partially flows into the expansion device 14*a* via the branch portion 27*b*. Due to the working of the expansion device 14*a*, the pressure of the refrigerant positioned on the upstream side of the expansion device 14*a* is set in the intermediate pressure state (indicated by point J in FIG. 7). Part of the two-phase refrigerant which is set in the intermediate pressure state by the expansion device 14*a* is diverted at the branch portion 27*b* and flows into the branch pipe 4*d*. This refrigerant then flows into the injection pipe 4*c* via the backflow preventing device 20 and flows into the compression chamber through the opening provided in the compression chamber of the compressor 10. In this case, due to a pressure drop occurring at the opening of the compression chamber (pressure drop occurring because of a sudden expansion or reduction of the flow of a refrigerant which flows through a narrow flow channel), the refrigerant flows into the compression chamber of the compressor 10 as a low-temperature intermediate-pressure two-phase refrigerant with a slightly reduced pressure (indicated by point K in FIG. 7). Within the compression chamber, the low-temperature intermediate-pressure two-phase refrigerant (indicated by point K in FIG. 7) is mixed with the intermediate-pressure gas refrigerant (indicated by point F in FIG. 7), thereby reducing the temperature of the refrigerant (indicated by point H in FIG. 7).

With this operation, the discharge temperature of the refrigerant discharged from the compressor 10 is reduced (indicated by point I in FIG. 7). The discharge temperature of the compressor 10 at the time at which such an injecting operation is not performed is indicated by point G in FIG. 7, and it is understood that the discharge temperature is reduced from point G to point I because the injecting operation has been performed. A refrigerant in a two-phase state flows into the branch portion 27*b*. Accordingly, in order to uniformly distribute the refrigerant, the branch portion 27*b* is configured such that the refrigerant is branched at the branch portion 27*b* in the state in which it flows from the bottom to the top side in the vertical direction. With this structure, the two-phase refrigerant is uniformly distributed.

In the heating only operation mode, by changing the opening degree of the expansion device 14*a*, the amount of refrigerant to be injected into the compression chamber of the compressor 10 is adjusted. As a result, the discharge temperature or the discharge superheat of the compressor 10 can be controlled.

In this case, the expansion device 14*b* is in the full closed state, or the opening degree of the expansion device 14*b* is small in such a degree as not to allow a refrigerant to flow therethrough. In this manner, a high-pressure refrigerant flowing through the branch portion 27*a* can be prevented from being mixed with an intermediate-pressure refrigerant passing through the backflow preventing device 20.

As the expansion device 14*a*, a device whose aperture area can be changed, such as an electronic expansion valve, is desirably used. If an electronic expansion valve is used, control can be performed so that the intermediate pressure on the upstream side of the expansion device 14*a* may be set to a desired pressure. For example, if control is performed so that the intermediate pressure detected by the intermediate-pressure detecting device 32 may be set to a constant value, the expansion device 14*a* can stably control the discharge temperature. However, the expansion device 14*a* is not restricted to an electronic expansion valve, and any device may be used as long as it can perform control so that the discharge temperature may be set to a target value. Although the controllability is slightly lowered, as the expansion device 14*a*, for example, on/off valves, such as small solenoid valves, are combined so as to select a plurality of aperture areas. Alternatively, as the expansion device 14*a*, a capillary tube may be used so as to form the intermediate pressure in accordance with a pressure drop occurring in a refrigerant. Moreover, the intermediate-pressure sensor 32 may be a pressure sensor. Alternatively, a temperature sensor may be used, and the intermediate pressure may be calculated.

A description will now be given of the flow of a heat medium in the heat medium circuit B.

In the heating only operation mode, heating energy of a heat source side refrigerant is transmitted to a heat medium in both of the heat exchangers 15*a* and 15*b* related to heat medium, and the heated heat medium circulates within the pipes 5 by using the pumps 21*a* and 21*b*. The heat medium pressurized in each of the pumps 21*a* and 21*b* flows out of the respective one of the pumps 21*a* and 21*b* into the use side heat exchangers 26*a* and 26*b* via the corresponding one of the second heat medium flow switching devise 23*a* and 23*b*. Then, the heat medium transfers heat to indoor air in the use side heat exchangers 26*a* and 26*b*, thereby heating the indoor space 7.

Then, the heat medium flows out of each of the use side heat exchangers 26*a* and 26*b* and flows into the corresponding one of the heat medium flow control devices 25*a* and 25*b*. In this case, due to the working of the heat medium flow control devices 25*a* and 25*b*, the flow rate of the heat medium is set to be a flow rate which is necessary to compensate for an air conditioning load required indoors, and then, the heat medium flows into the use side heat exchangers 26*a* and 26*b*. The heat medium flowing out of each of the heat medium flow control devices 25*a* and 25*b* passes through the corresponding one of the first heat medium flow switching devices 22*a* and 22*b*, flows into the heat exchangers 15*a* and 15*b* related to heat medium, and is then sucked into the pumps 21*a* and 21*b* again.

In the pipes 5 connected to the use side heat exchanger 26, a heat medium flows in the direction from the second heat medium flow switching device 23 to the first heat medium flow switching device 22 via the heat medium flow control device 25. An air conditioning load required in the indoor space 7 can be satisfied by performing control so that the difference between the temperature detected by the first temperature sensor 31*a* or 31*b* and the temperature detected by the second temperature sensor 34 will be maintained at a target value. As the temperature at the outlet of the heat exchanger 15 related to heat medium, either of the temperature of the first temperature sensor 31*a* or that of the first temperature sensor 31*b* may be used, or the average of these temperatures may be used.

In this case, the opening degrees of the first heat medium flow switching device 22 and the second heat medium flow switching device 23 are set to be an intermediate opening degree so that it is possible to secure flow channels through which a heat medium flows both to the heat exchangers 15*a* and 15*b* related to heat medium. Additionally, the use side heat exchanger 26*a* should be controlled by the difference between the temperature at the inlet and that at the outlet. However, the temperature of a heat medium at the inlet side of the use side heat exchanger 26 is substantially the same as the temperature detected by the first temperature sensor 31*b*. Accordingly, by the use of the first temperature sensor 31*b*, the number of temperature sensors can be decreased, and the system can be constructed at low cost. As in the cooling only operation mode, the opening degree of the heat medium flow control device 25 is controlled depending on whether or not there is a heating load in the use side heat exchanger 26.

[Cooling Main Operation Mode]

Figure 8:
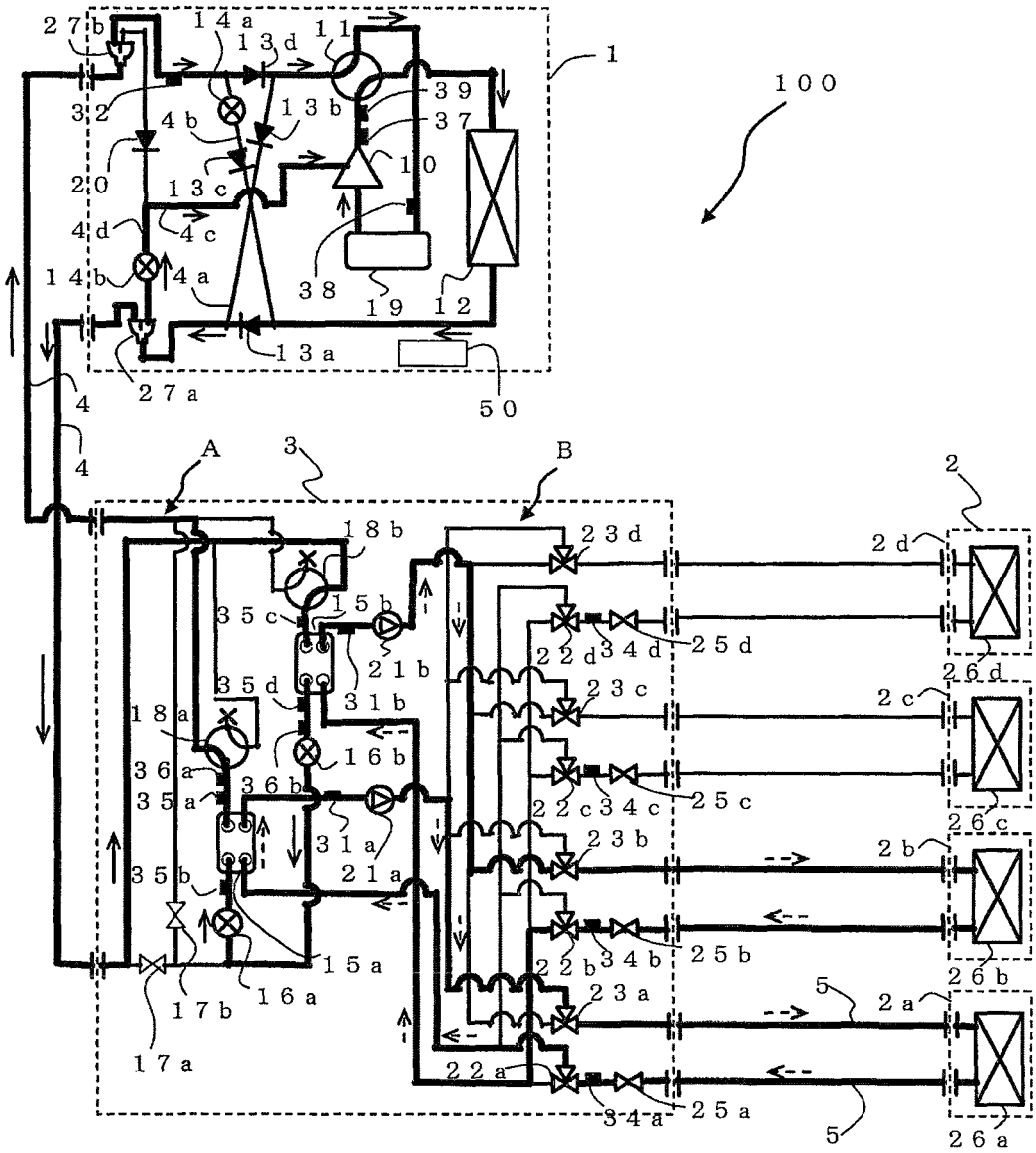
FIG. 8 is a refrigerant circuit diagram illustrating the flow of a refrigerant in a cooling main operation mode performed by the air-conditioning apparatus according to Embodiment 1 of the present invention.

FIG. 8 is a refrigerant circuit diagram illustrating the flow of a refrigerant in the cooling main operation mode performed by the air-conditioning apparatus 100. The cooling main operation mode will be discussed with reference to FIG. 8 by taking, as an example, a case in which a cooling load is generated in the use side heat exchanger 26*a* and a heating load is generated in the use side heat exchanger 26*b*. In FIG. 8, the pipes indicated by the thick lines are pipes through which refrigerants (a heat source side refrigerant and a heat medium) circulate. In FIG. 8, the direction in which a heat source side refrigerant flows is indicated by the solid arrows, and the direction in which a heat medium flows is indicated by the dotted arrows.

In the case of the cooling main operation mode shown in FIG. 8, in the outdoor unit 1, the first refrigerant flow switching device 11 is switched so that a heat source side refrigerant discharged from the compressor 10 will flow into the heat source side heat exchanger 12. In the heat medium relay unit 3, the pumps 21*a* and 21*b* are driven to open the heat medium flow control devices 25*a* and 25*b* and to set the heat medium flow control devices 25*c* and 25*d* in the full closed state, thereby allowing a heat medium to circulate between the heat exchanger 15*a* related to heat medium and the use side heat exchanger 26*a* and between the heat exchanger 15*b* related to heat medium and the use side heat exchanger 26*b*.

A description will first be given of the flow of a heat source side refrigerant in the refrigerant circuit A.

A low-temperature low-pressure refrigerant is compressed by the compressor 10 and is discharged as a high-temperature high-pressure gas refrigerant. The high-temperature high-pressure gas refrigerant discharged from the compressor 10 flows into the heat source side heat exchanger 12 via the first refrigerant flow switching device 11. Then, in the heat source side heat exchanger 12, the high-temperature high-pressure gas refrigerant is condensed into a two-phase refrigerant while transferring heat to outdoor air. The two-phase refrigerant flowing out of the heat source side heat exchanger 12 passes through the check valve 13*a* and partially flows out of the outdoor unit 1 via the branch portion 27*a* and flows into the heat medium relay unit 3 via the refrigerant pipe 4. The two-phase refrigerant flowing into the heat medium relay unit 3 passes through the second refrigerant flow switching device 18*b* and flows into the heat exchanger 15*b* related to heat medium, which serves as a condenser.

The two-phase refrigerant flowing into the heat exchanger 15*b* related to heat medium is condensed and liquefied while transferring heat to a heat medium circulating in the heat medium circuit B, and is transformed into a liquid refrigerant. The liquid refrigerant flowing out of the heat exchanger 15*b* related to heat medium is expanded into a low-pressure two-phase refrigerant in the expansion device 16*b*. This low-pressure two-phase refrigerant flows into the heat exchanger 15*a* related to heat medium, which serves as an evaporator, via the expansion device 16*a*. The low-pressure two-phase refrigerant flowing into the heat exchanger 15*a* related to heat medium absorbs heat from a heat medium circulating in the heat medium circuit B and is thereby transformed into a low-pressure gas refrigerant while cooling the heat medium. This gas refrigerant flows out of the heat exchanger 15*a* related to heat medium, flows out of the heat medium relay unit 3 via the second refrigerant flow switching device 18*a*, and again flows into the outdoor unit 1 via the refrigerant pipe 4. The refrigerant flowing into the outdoor unit 1 passes through the check value 13*d* via the branch portion 27*b* and is again sucked into the compressor 10 via the first refrigerant flow switching device 11 and the accumulator 19.

In this case, the opening degree (aperture area) of the expansion device 16*b* is controlled so that the superheat obtained as a difference between the temperature detected by the third temperature sensor 35*a* and the temperature detected by the third temperature sensor 35*b* will become constant. The expansion device 16*a* is set in the full opened state. The opening/closing device 17*a* is closed, and the opening/closing device 17*b* is closed. The opening degree of the expansion device 16*b* may be controlled so that the subcool obtained as a difference between the saturation temperature converted from the pressure detected by the pressure sensor 36 and the temperature detected by the third temperature sensor 35*d* may be constant. Additionally, the expansion device 16*b* may be set in the full opened state, and the superheat or subcool may be controlled by using the expansion device 16*a*.

Figure 9:
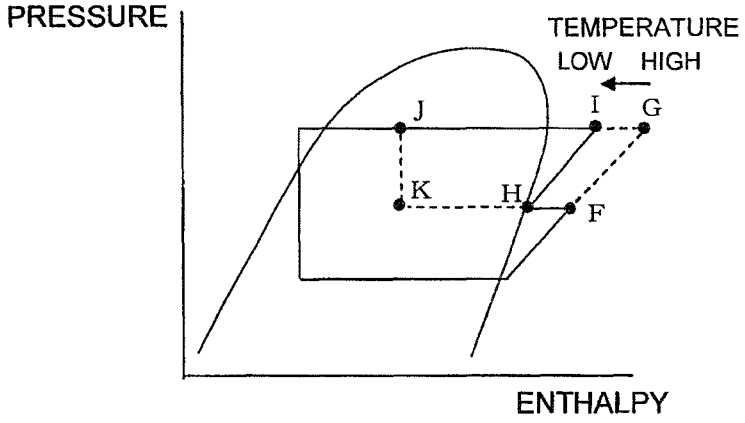
FIG. 9 is a p-h diagram illustrating a state transition of a heat source side refrigerant during a cooling main operation mode performed by the air-conditioning apparatus according to Embodiment 1 of the present invention.

If R32 is used as the heat source side refrigerant, the discharge temperature of the compressor 10 may become higher, and thus, by using an injection circuit, the discharge temperature is decreased. The operation to be performed in this case will be discussed below with reference to FIGS. 8 and 9. FIG. 9 is a p-h diagram (pressure-enthalpy diagram) illustrating a state transition of a heat source side refrigerant during the cooling main operation mode. In FIG. 9, the vertical axis indicates the pressure, and the horizontal axis indicates enthalpy.

In the compressor 10, a low-temperature low-pressure gas refrigerant sucked from the suction inlet of the compressor 10 is fed into an air-tight container, and the low-temperature low-pressure gas refrigerant filling the air-tight container is sucked into a compression chamber (not shown). As the compression chamber is being rotated at 0 to 360 degrees by a motor (not shown), the internal capacity of the compression chamber decreases. As the internal capacity of the compression chamber decreases, the refrigerant sucked into the compression chamber is compressed so as to increase the pressure and the temperature. When the rotation angle of the motor reaches a certain angle, an opening (formed in part of the compression chamber) is opened (this state is indicated by point F in FIG. 9), and the inside of the compression chamber and the injection pipe 4*c* positioned outside the compressor 10 communicate with each other.

In the cooling main operation mode, the refrigerant compressed in the compressor 10 is condensed into a high-pressure two-phase refrigerant in the heat source side heat exchanger 12 (indicated by point J in FIG. 9). The high-pressure two-phase refrigerant then reaches the branch portion 27*a* via the check valve 13*a*. This high-pressure two-phase refrigerant is branched at the branch portion 27*a*, and part of the refrigerant is decompressed into a low-temperature intermediate-pressure two-phase refrigerant in the expansion device 14*b*. The low-temperature intermediate-pressure two-phase refrigerant then flows into the injection pipe 4*c* via the branch pipe 4*d*. The refrigerant flowing into the injection pipe 4*c* flows into the compression chamber through the opening formed in the compression chamber of the compressor 10. In this case, due to a port pressure drop occurring at an injection port (not shown) of the compression chamber (pressure drop occurring because a refrigerant passes through a narrow flow channel), the refrigerant flows into the compression chamber of the compressor 10 as a low-temperature intermediate-pressure two-phase refrigerant with a slightly reduced pressure (indicated by point K in FIG. 9). Within the compression chamber, the low-temperature intermediate-pressure two-phase refrigerant (indicated by point K in FIG. 9) is mixed with the intermediate-pressure gas refrigerant (indicated by point F in FIG. 9), thereby reducing the temperature of the refrigerant (indicated by point H in FIG. 9).

With this operation, the discharge temperature of the refrigerant discharged from the compressor 10 is reduced (indicated by point I in FIG. 9). The discharge temperature of the compressor 10 when such an injecting operation is not performed is indicated by point G in FIG. 9, and it is understood that the discharge temperature is reduced from point G to point I because the injecting operation has been performed. A refrigerant in a two-phase state flows into the branch portion 27*a*. Accordingly, in order to uniformly distribute the refrigerant, the branch portion 27*a* is configured such that the refrigerant is branched at the branch portion 27*a* in the state in which it flows from the bottom to the top side in the vertical direction. With this structure, the two-phase refrigerant is uniformly distributed.

As in the cooling only operation mode, in the cooling main operation mode, by changing the opening degree of the expansion device 14*b*, the pressure of a refrigerant positioned on the upstream side of the expansion device 14*b* is changed, thereby controlling the amount of refrigerant to be injected into the compression chamber of the compressor 10. As a result, the discharge temperature or the discharge superheat of the compressor 10 can be controlled. As in the cooling only operation mode, due to the working of the backflow preventing device 20, the intermediate-pressure refrigerant flowing through the branch pipe 4*d* is prevented from being mixed with the low-pressure refrigerant flowing at the branch portion 27*b*. Moreover, since a refrigerant does not flow through the expansion device 14*a*, the opening degree of the expansion device 14*a* may be set to a desired opening degree.

A description will now be given of the flow of a heat medium in the heat medium circuit B.

In the cooling main operation mode, heating energy of a heat source side refrigerant is transmitted to a heat medium in the heat exchanger 15*b* related to heat medium, and the heated heat medium circulates within the pipes 5 by using the pump 21*b*. Moreover, in the cooling main operation mode, cooling energy of a heat source side refrigerant is transmitted to a heat medium in the heat exchanger 15*a* related to heat medium, and the cooled heat medium circulates within the pipes 5 by using the pump 21*a*. The heat medium pressurized in each of the pumps 21*a* and 21*b* flows into the use side heat exchangers 26*a* and 26*b* via the corresponding one of the second heat medium flow switching devise 23*a* and 23*b*.

In the use side heat exchanger 26*b*, the heat medium transfers heat to indoor air, thereby heating the indoor space 7. In the use side heat exchanger 26*a*, the heat medium absorbs heat from indoor air, thereby cooling the indoor space 7. In this case, due to the working of the heat medium flow control devices 25*a* and 25*b*, the flow rate of the heat medium is set to be a flow rate which is necessary to compensate for an air conditioning load required indoors, and then, the heat medium flows into each of the use side heat exchangers 26*a* and 26*b*. The heat medium with a slightly reduced temperature after passing through the use side heat exchanger 26*b* passes through the heat medium flow control device 25*b* and the first heat medium flow switching device 22*b*, flows into the heat exchanger 15*b* related to heat medium, and is then sucked into the pump 21*b* again. The heat medium with a slightly increased temperature after passing through the use side heat exchanger 26*a* passes through the heat medium flow control device 25*a* and the first heat medium flow switching device 22*a*, flows into the heat exchanger 15*a* related to heat medium, and is then sucked into the pump 21*a* again.

During this operation, due to the working of the first and second heat medium flow switching devices 22 and 23, a heated heat medium and a cooled heat medium are respectively fed to a use side heat exchanger 26 with a heating load and a use side heat exchanger 26 with a cooling load without being mixed with each other. In the pipes 5 connected to the use side heat exchangers 26 for both of the heating side and the cooling side, a heat medium flows in the direction from the second heat medium flow switching devices 23 to the first heat medium flow switching devices 22 via the heat medium flow control devices 25. An air conditioning load required in the indoor space 7 can be compensated for by performing control so that, for the heating side, the difference between the temperature detected by the first temperature sensor 31*b* and the temperature detected by the second temperature sensor 34 will be maintained at a target value, and so that, for the cooling side, the difference between the temperature detected by the first temperature sensor 31*a* and the temperature detected by the second temperature sensor 34 will be maintained at a target value.

As in the cooling only operation mode and the heating only operation mode, the opening degree of the heat medium flow control device 25 is controlled depending on whether or not there is a heating load in the use side heat exchanger 26.

[Heating Main Operation Mode]

Figure 10:
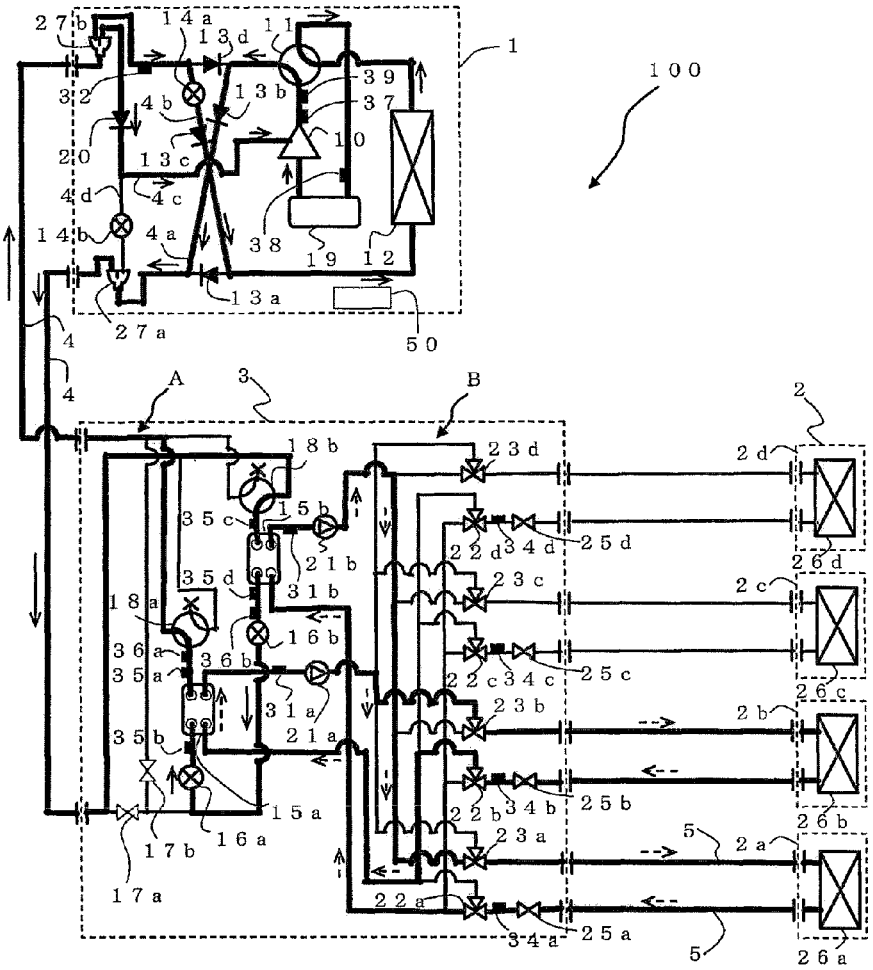
FIG. 10 is a refrigerant circuit diagram illustrating the flow of a refrigerant in a heating main operation mode performed by the air-conditioning apparatus according to Embodiment 1 of the present invention.

FIG. 10 is a refrigerant circuit diagram illustrating the flow of a refrigerant in the heating main operation mode performed by the air-conditioning apparatus 100. The heating main operation mode will be discussed with reference to FIG. 10 by taking, as an example, a case in which a heating load is generated in the use side heat exchanger 26*a* and a cooling load is generated in the use side heat exchanger 26*b*. In FIG. 10, the pipes indicated by the thick lines are pipes through which refrigerants (a heat source side refrigerant and a heat medium) circulate. In FIG. 10, the direction in which a heat source side refrigerant flows is indicated by the solid arrows, and the direction in which a heat medium flows is indicated by the dotted arrows.

In the case of the heating main operation mode shown in FIG. 10, in the outdoor unit 1, the first refrigerant flow switching device 11 is switched so that a heat source side refrigerant discharged from the compressor 10 will flow into the heat medium relay unit 3 without passing through the heat source side heat exchanger 12. In the heat medium relay unit 3, the pumps 21*a* and 21*b* are driven to open the heat medium flow control devices 25*a* and 25*b* and to set the heat medium flow control devices 25*c* and 25*d* in the full closed state, thereby allowing a heat medium to circulate between the heat exchanger 15*a* related to heat medium and the use side heat exchanger 26*b* and between the heat exchanger 15*b* related to heat medium and the use side heat exchanger 26*a*.

A description will first be given of the flow of a heat source side refrigerant in the refrigerant circuit A.

A low-temperature low-pressure refrigerant is compressed by the compressor 10 and is discharged as a high-temperature high-pressure gas refrigerant. The high-temperature high-pressure gas refrigerant discharged from the compressor 10 passes through the first refrigerant flow switching device 11 and the first connecting pipe 4*a*, passes through the check value 13*b*, and flows out of the outdoor unit 1 via the branch portion 27*a*. The high-temperature high-pressure gas refrigerant flowing out of the outdoor unit 1 flows into the heat medium relay unit 3 via the refrigerant pipe 4. The high-temperature high-pressure gas refrigerant flowing into the heat medium relay unit 3 passes through the second refrigerant flow switching device 18*b* and flows into the heat exchanger 15*b* related to heat medium, which serves as a condenser.

The gas refrigerant flowing into the heat exchanger 15*b* related to heat medium is condensed and liquefied while transferring heat to a heat medium circulating in the heat medium circuit B, and is transformed into a liquid refrigerant. The liquid refrigerant flowing out of the heat exchanger 15*b* related to heat medium is expanded to an intermediate-pressure two-phase refrigerant in the expansion device 16*b*. This intermediate-pressure two-phase refrigerant flows into the heat exchanger 15*a* related to heat medium, which serves as an evaporator, via the expansion device 16*a*. The intermediate-pressure two-phase refrigerant flowing into the heat exchanger 15*a* related to heat medium absorbs heat from a heat medium circulating in the heat medium circuit B so as to evaporate, thereby cooling the heat medium. This intermediate-pressure two-phase refrigerant flows out of the heat exchanger 15*a* related to heat medium, flows out of the heat medium relay unit 3 via the second refrigerant flow switching device 18*a*, and again flows into the outdoor unit 1 via the refrigerant pipe 4.

The refrigerant flowing into the outdoor unit 1 partially flows into the second connecting pipe 4*b* via the branch portion 27*b* and passes through the expansion device 14*a*. At this time, the refrigerant flow is regulated in the expansion device 14*a* and is transformed into a low-temperature low-pressure two-phase refrigerant. This two-phase refrigerant passes through the check valve 13*c* and flows into the heat source side heat exchanger 12, which serves as an evaporator. Then, the refrigerant flowing into the heat source side heat exchanger 12 absorbs heat from outdoor air in the heat source side heat exchanger 12 and is transformed into a low-temperature low-pressure gas refrigerant. The low-temperature low-pressure gas refrigerant flowing out of the heat source side heat exchanger 12 is again sucked into the compressor 10 via the first refrigerant flow switching device 11 and the accumulator 19.

In this case, the opening degree of the expansion device 16*b* is controlled so that subcooling obtained as a difference between the saturation temperature converted from the pressure detected by the pressure sensor 36 and the temperature detected by the third temperature sensor 35*b* will become constant. The expansion device 16*a* is set in the full opened state. The opening/closing device 17*a* is closed, and the opening/closing device 17*b* is closed. The expansion device 16*b* may be set in the full opened state, and subcooling may be controlled by using the expansion device 16*a*.

Figure 11:
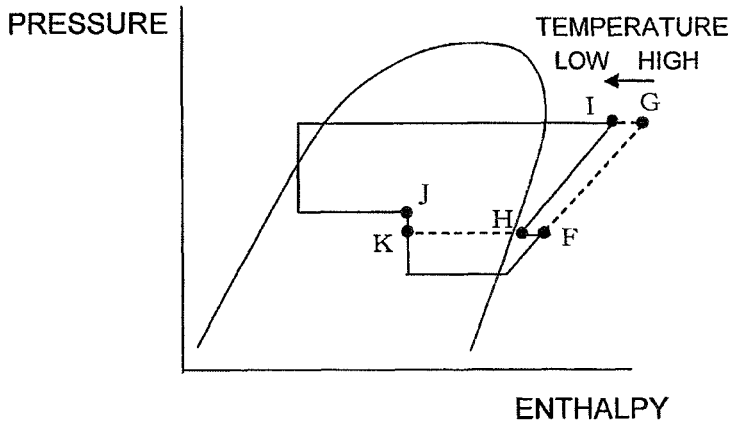
FIG. 11 is a p-h diagram illustrating a state transition of a heat source side refrigerant during a heating main operation mode performed by the air-conditioning apparatus according to Embodiment 1 of the present invention.

If R32 is used as the heat source side refrigerant, the discharge temperature of the compressor 10 may become higher, and thus, by using an injection circuit, the discharge temperature is decreased. The operation to be performed in this case will be discussed below with reference to FIGS. 10 and 11. FIG. 11 is a p-h diagram (pressure-enthalpy diagram) illustrating a state transition of a heat source side refrigerant during the heating main operation mode. In FIG. 11, the vertical axis indicates the pressure, and the horizontal axis indicates enthalpy.

In the compressor 10, a low-temperature low-pressure gas refrigerant sucked from the suction inlet of the compressor 10 is fed into an air-tight container, and the low-temperature low-pressure gas refrigerant filling the air-tight container is sucked into a compression chamber (not shown). As the compression chamber is being rotated at 0 to 360 degrees by a motor (not shown), the internal capacity of the compression chamber decreases. As the internal capacity of the compression chamber decreases, the refrigerant sucked into the compression chamber is compressed so as to increase the pressure and the temperature thereof. When the rotation angle of the motor reaches a certain angle, an opening (formed in part of the compression chamber) is opened (this state is indicated by point F in FIG. 11), and the inside of the compression chamber and the injection pipe 4*c* positioned outside the compressor 10 communicate with each other.

In the heating main operation mode, the refrigerant returning from the heat medium relay unit 3 to the outdoor unit 1 via the refrigerant pipe 4 partially flows into the expansion device 14*a* via the branch portion 27*b*. Due to the function of the expansion device 14*a*, the pressure of the refrigerant positioned on the working side of the expansion device 14*a* is set in the intermediate pressure state (indicated by point J in FIG. 11). Part of the two-phase refrigerant which is set in the intermediate pressure state by the expansion device 14*a* is diverted at the branch portion 27*b* and flows into the branch pipe 4*d*. This refrigerant then flows into the injection pipe 4*c* via the backflow preventing device 20 and flows into the compression chamber through the opening provided in the compression chamber of the compressor 10. In this case, due to a pressure drop occurring at the opening of the compression chamber (pressure drop occurring because of a sudden expansion or reduction of the flow of a refrigerant which flows through a narrow flow channel), the refrigerant flows into the compression chamber of the compressor 10 as a low-temperature intermediate-pressure two-phase refrigerant with a slightly reduced pressure (indicated by point K in FIG. 11). Within the compression chamber, the low-temperature intermediate-pressure two-phase refrigerant (indicated by point K in FIG. 11) is mixed with the intermediate-pressure gas refrigerant (indicated by point F in FIG. 11), thereby reducing the temperature of the refrigerant (indicated by point H in FIG. 11).

With this operation, the discharge temperature of the refrigerant discharged from the compressor 10 is reduced (indicated by point I in FIG. 11). The discharge temperature of the compressor 10 when such an injecting operation is not performed is indicated by point G in FIG. 11, and it is understood that the discharge temperature is reduced from point G to point I because the injecting operation has been performed. As discussed with reference to the heating only operation mode, the branch portion 27*b* is configured such that a refrigerant is branched at the branch portion 27*b* in the state in which it flows from the bottom to the top side in the vertical direction.

In the heating main operation mode, as in the heating only operation mode, by changing the opening degree of the expansion device 14*a*, the amount of refrigerant to be injected into the compression chamber of the compressor 10 is controlled. As a result, the discharge temperature or the discharge superheat of the compressor 10 can be controlled.

In this case, the expansion device 14*b* is in the full closed state, or the opening degree of the expansion device 14*b* is small to such a degree as not to allow a refrigerant to flow therethrough. In this manner, a high-pressure refrigerant flowing through the branch portion 27*a* can be prevented from being mixed with an intermediate-pressure refrigerant passing through the backflow preventing device 20. The expansion device 14*a* may be controlled, as discussed with reference to the heating only operation mode. The intermediate-pressure detecting device 32 may be configured and the expansion device 14*b* may be configured and controlled, as discussed with reference to the heating only operation mode.

A description will now be given of the flow of a heat medium in the heat medium circuit B.

In the heating main operation mode, heating energy of a heat source side refrigerant is transmitted to a heat medium in the heat exchanger 15*b* related to heat medium, and the heated heat medium is circulated within the pipes 5 by the pump 21*b*. Additionally, in the heating main operation mode, cooling energy of a heat source side refrigerant is transmitted to a heat medium in the heat exchanger 15*a* related to heat medium, and the cooled heat medium circulates within the pipes 5 by using the pump 21*a*. The heat medium pressurized in each of the pumps 21*a* and 21*b* flows into the use side heat exchangers 26*b* and 26*a* via the corresponding one of the second heat medium flow switching devise 23*b* and 23*a*.

In the use side heat exchanger 26*b*, the heat medium absorbs heat from indoor air, thereby cooling the indoor space 7. In the use side heat exchanger 26*a*, the heat medium transfers heat to indoor air, thereby heating the indoor space 7. In this case, due to the working of the heat medium flow control devices 25*a* and 25*b*, the flow rate of the heat medium is set to be a flow rate which is necessary to satisfy an air conditioning load required indoors, and then, the heat medium flows into the use side heat exchangers 26*a* and 26*b*. The heat medium with a slightly increased temperature after passing through the use side heat exchanger 26*b* passes through the heat medium flow control device 25*b* and the first heat medium flow switching devices 22*b*, flows into the heat exchanger 15*a* related to heat medium, and is then sucked into the pump 21*a* again. The heat medium with a slightly reduced temperature after passing through the use side heat exchanger 26*a* passes through the heat medium flow control device 25*a* and the first heat medium flow switching devices 22*a*, flows into the heat exchanger 15*b* related to heat medium, and is then sucked into the pump 21*b* again.

During this operation, due to the working of the first and second heat medium flow switching devices 22 and 23, a heated heat medium and a cooled heat medium are respectively fed to a use side heat exchanger 26 with a heating load and a use side heat exchanger 26 with a cooling load without being mixed with each other. In the pipes 5 connected to the use side heat exchangers 26 for both of the heating side and the cooling side, a heat medium flows in the direction from the second heat medium flow switching devices 23 to the first heat medium flow switching devices 22 via the heat medium flow control devices 25. An air conditioning load required in the indoor space 7 can be compensated for by performing control so that, for the heating side, the difference between the temperature detected by the first temperature sensor 31*b* and the temperature detected by the second temperature sensor 34 will be maintained at a target value, and so that, for the cooling side, the difference between the temperature detected by the first temperature sensor 31*a* and the temperature detected by the second temperature sensor 34 will be maintained at a target value.

As in the cooling only operation mode, the heating only operation mode, and the cooling main operation mode, the opening degree of the heat medium flow control device 25 is controlled depending on whether or not there is a heating load in the use side heat exchanger 26.

[Expansion Device 14*a* and/or Expansion Device 14*b*]

The injecting operations for injecting a refrigerant to the compression chamber of the compressor 10 in the individual operation modes are performed as described above. Accordingly, a refrigerant in a two-phase state flows into the expansion device 14*a* during the heating only operation mode and the heating main operation mode. A liquid refrigerant flows into the expansion device 14*b* during the cooling only operation mode, and a refrigerant in a two-phase state flows into the expansion device 14*b* during the cooling main operation mode.

In the case of the use of an electronic expansion valve as the expansion device, if a two-phase refrigerant flows into the expansion device in the state in which a gas refrigerant and a liquid refrigerant are separated, a state in which a gas flows and a state in which a liquid flows are separately generated at an expanding portion. As a result, the pressure at the outlet of the expansion device may become unstable. This is more likely to happen particularly when the quality of a refrigerant is small because the separation of the refrigerant is accelerated. Accordingly, as the expansion device 14*a* and/or the expansion device 14*b*, an expansion device having a structure shown in FIG. 12 may be used. Then, even if a two-phase refrigerant flows into the expansion device, control can be performed stably.

Figure 12:
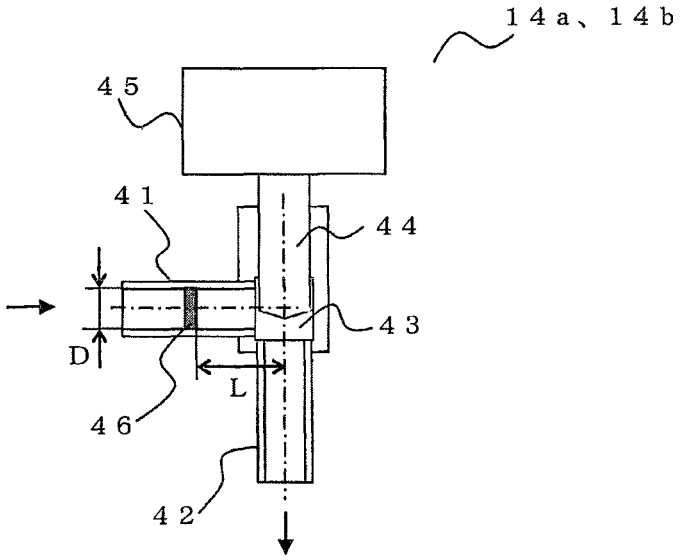
FIG. 12 schematically illustrates an example of the suitable configuration of an expansion device.

FIG. 12 schematically illustrates an example of the suitable configuration of the expansion device 14*a* and/or the expansion device 14*b* (hereinafter collectively referred to as the "expansion device 14"). In FIG. 12, the expansion device 14 includes an inlet pipe 41, an outlet pipe 42, an expanding portion 43, a valve body 44, a motor 45, and an agitator 46. The agitator 46 is installed within the inlet pipe 41.

A two-phase refrigerant flowing out of the inlet pipe 41 reaches the agitator 46, and due to the working of the agitator 46, a gas refrigerant and a liquid refrigerant are agitated and mixed with each other substantially uniformly. The two-phase refrigerant in which the gas refrigerant and the liquid refrigerant are mixed with each other substantially uniformly due to the working of the agitator 46 reaches the expanding portion 43. The flow of the two-phase refrigerant is then regulated by the valve body 44 in the expanding portion 43 and is thereby decompressed, and then flows out of the outlet pipe 42. In this case, the position of the valve body 44 is controlled by the motor 45, and thus, the amount by which the refrigerant flow is regulated in the expanding portion 43 is controlled.

As the agitator 46, any type may be used as long as it can produce a state in which a gas refrigerant and a liquid refrigerant are mixed with each other substantially uniformly. For example, the agitator 46 can be implemented by using metal foam. The metal foam is a metallic porous body having a three-dimensional mesh structure, like a resin foam body, such as a sponge, and has a largest porosity ratio (void ratio) (80 to 97%) among metallic porous bodies. If a two-phase refrigerant is distributed through this metal foam, the gas within the refrigerant becomes finer and is agitated, thereby being effectively mixed with a liquid uniformly, by the influence of the three-dimensional mesh structure.

In the field of fluid dynamics, it has been clarified that, when the internal diameter and the length of pipes (the inlet pipe 41 and the outlet pipe 42) of the expansion device 14 are indicated by D and L, respectively, if the flow of a refrigerant within the pipes reaches a distance by which L/D becomes 8 to 10 from a portion having a structure which disturbs the flow, the flow returns to the original state free from the influence of the disturbance of the flow. Accordingly, when the internal diameter of the inlet pipe 41 of the expansion device 14 is indicated by D and the length from the agitator 46 to the expanding portion 43 is indicated by L, the agitator 46 is installed at a position at which L/D is 6 or smaller. Then, the agitated two-phase refrigerant can reach the expanding portion 43 while maintaining its agitated state, whereby control can be performed stably.

[Refrigerant Pipes 4]

As described above, the air-conditioning apparatus 100 according to Embodiment 1 has several operation modes. In these operation modes, a heat source side refrigerant flows through the pipes 4 which connect the outdoor unit 1 and the heat medium relay unit 3.

[Pipes 5]

In some of the operation modes performed by the air-conditioning apparatus 100 according to Embodiment 1, a heat medium, such as water or an antifreeze, flows through the pipes 5 which connect the heat medium relay unit 3 and the indoor units 2.

A description has been given of the case in which the pressure sensor 36*a* is installed in the flow channel between the second refrigerant flow switching device 18*a* and the heat exchanger 15*a* related to heat medium, which serves as a cooling side during the cooling and heating mixed operation, and the pressure sensor 36*b* is installed in the flow channel between the expansion device 16*b* and the heat exchanger 15*b* related to heat medium, which serves as a heating side during the cooling and heating mixed operation. By installing the pressure sensors 36*a* and 36*b* at such positions, even if a pressure drop occurs in the heat exchangers 15*a* and 15*b* related to heat medium, the saturation temperature can be calculated with high precision. However, since a pressure drop occurring at a condensing side is small, the pressure sensor 36*b* may be installed in the flow channel between the heat exchanger 15*b* related to heat medium and the expansion device 16*b*, in which case, the calculation precision is not considerably decreased. Moreover, although a pressure drop occurring at an evaporator is comparatively large, if the amount of pressure drop is predictable or if a heat exchanger related to heat medium which causes only a small pressure drop is used, the pressure sensor 36*a* may be installed in the flow channel between the heat exchanger 15*a* related to heat medium and the second refrigerant flow switching device 18*a*.

In the air-conditioning apparatus 100, if only a heating load or only a cooling load is generated in the use side heat exchangers 26, the opening degrees of the associated first and second heat medium flow switching devices 22 and 23 are set to be an intermediate opening degree, thereby allowing a heat medium to flow both through the heat exchangers 15*a* and 15*b* related to heat medium. With this arrangement, both of the heat exchangers 15*a* and 15*b* related to heat medium can be used for the heating operation or the cooling operation, and thus, the heat transfer area is increased, thereby implementing a high-efficiency heating operation or cooling operation.

In contrast, if both of a heating load and a cooling load are generated in the use side heat exchangers 26, the first and second heat medium flow switching devices 22 and 23 corresponding to a use side heat exchanger 26 which performs a heating operation are switched to the flow channel connected to the heat exchanger 15*b* related to heat medium used for heating, and the first and second heat medium flow switching devices 22 and 23 corresponding to a use side heat exchanger 26 which performs a cooling operation are switched to the flow channel connected to the heat exchanger 15*a* related to heat medium used for cooling. As a result, in each of the indoor units 2, a heating operation or a cooling operation can be performed as desired.

As the first and second heat medium flow switching devices 22 and 23 discussed in Embodiment 1, any type of device that can switch the flow channel may be used. For example, devices that can switch a three-way passage, such as three-port valves, or a combination of two devices that open and close a two-way passage, such as on/off valves, may be used. Alternatively, as the first and second heat medium flow switching devices 22 and 23, a device that can change the flow rate of a three-way passage, such as a stepping motor driving type mixing valve, or a combination of two devices that can change the flow rate of a two-way passage, such as electronic expansion valves, may be used. In this case, the occurrence of water hammer caused by the sudden opening or closing of a flow channel may be prevented. Additionally, in Embodiment 1, a case in which the heat medium flow control device 25 is a two-port valve has been discussed by way of example. However, the heat medium flow control device 25 may be a control valve having a three-way passage, and may be installed together with a bypass pipe that bypasses the use side heat exchanger 26.

As the heat medium flow control device 25, a stepping motor driving type device that can control the flow rate of a refrigerant flowing through a flow channel may be used, in which case, a two-port valve or a three-port valve with one port closed may be used. Alternatively, as the heat medium flow control device 25, a device that opens and closes a two-way passage, such as an on/off valve, may be used, in which case, the heat medium flow control device 25 may control an average flow rate by repeating ON/OFF operations.

As stated above, a four-way valve may be used as the second refrigerant flow switching device 18. However, the second refrigerant flow switching device 18 is not restricted to a four-way valve. Instead, a plurality of two-way passage switching valves or three-way passage switching valves may be used, and may be configured such that a refrigerant flows therethrough similarly to the case in which a four-way valve is used.

Needless to say that, even when only one use side heat exchanger 26 and only one heat medium flow control device 25 are connected, the above-described alternatives may be established. Further, as each of the heat exchanger 15 related to heat medium and the expansion device 16, a plurality of devices which function in the same manner may be provided without any problem. Moreover, a case in which the heat medium flow control device 25 is contained within the heat medium relay unit 3 has been discussed by way of example. However, this is not the only case, and the heat medium flow control device 25 may be within the indoor unit 2, and the heat medium relay unit 3 and the indoor unit 2 may be configured separately.

As a heat medium, for example, brine (antifreeze) or water, a mixed solution of brine and water, a mixed solution of water and an additive having a high anticorrosive effect, and so on, may be used. Accordingly, in the air-conditioning apparatus 100, since a heat medium having a high level of safety is used, even if such a heat medium leaks to the indoor space 7 via the indoor unit 2, a contribution to the enhancement of safety can be implemented.

In Embodiment 1, a case in which the accumulator 19 is included in the air-conditioning apparatus 100 has been discussed by way of example. However, the provision of the accumulator 19 may be omitted. Generally, in many cases, an air-sending device is fixed to the heat source side heat exchanger 12 and the use side heat exchangers 26*a* through 26*d*, thereby accelerating condensation or evaporation by sending air. However, the heat source side heat exchanger 12 and the use side heat exchangers 26*a* through 26*d* are not restricted to this type. For example, as the use side heat exchangers 26*a* through 26*d*, a panel heater utilizing radiation may be used, and as the heat source side heat exchanger 12, a water-cooled type device which can transfer heat by using water or an antifreeze may be used. Any type of device may be used as long as it is configured such that it can transfer or receive heat.

In Embodiment 1, a case in which four use side heat exchangers 26*a* through 26*d* are provided has been discussed by way of example. However, any number of use side heat exchangers 26 may be connected. Additionally, a case in which two heat exchangers 15*a* and 15*b* related to heat medium are provided has been discussed by way of example. However, the number of heat exchangers 15 related to heat medium is not restricted to two, and any number of heat exchangers 15 related to heat medium may be installed as long as they are configured such that they can cool and/or heat a heat medium. Moreover, the number of pumps 21*a* and the number of pumps 21*b* is not restricted to one, and a plurality of small-capacity pumps may be connected in parallel with each other.

As described above, in the air-conditioning apparatus 100 according to Embodiment 1, even if a refrigerant which makes the discharge temperature of the compressor 10 high, such as, R32, is used, control can be performed, regardless of the operation mode, so that the discharge temperature does not become excessively high, by injecting a refrigerant into the compression chamber of the compressor 10 which is in a course of performing compression. In the air-conditioning apparatus 100, therefore, by effectively controlling the discharge temperature of the compressor 10, a refrigerant and a cooling and heating device can be prevented from being deteriorated. It is thus possible to continue a safe operation.

A defrosting operation will be discussed below.

In the heating only operation mode and the heating main operation mode, if the temperature of air around the heat source side heat exchanger 12 is low, a below-freezing low-temperature low-pressure refrigerant flows into the pipe of the heat source side heat exchanger 12, thereby causing the occurrence of frost formation around the heat source side heat exchanger 12. If frost formation occurs around the heat source side heat exchanger 12, a frost layer generates a thermal resistance, and also, the flow channel through which air around the heat source side heat exchanger 12 flows becomes narrow, thereby making it difficult for air to flow through the flow channel. This inhibits heat exchange between a refrigerant and air, thereby decreasing the heating capacity and operating efficiency of the unit. Accordingly, if frost formation of the heat source side heat exchanger 12 is accelerated, a defrosting operation for defrosting a portion around the heat source side heat exchanger 12 is performed.

The defrosting operation in Embodiment 1 will be discussed below with reference to FIG. 13.

Figure 13:
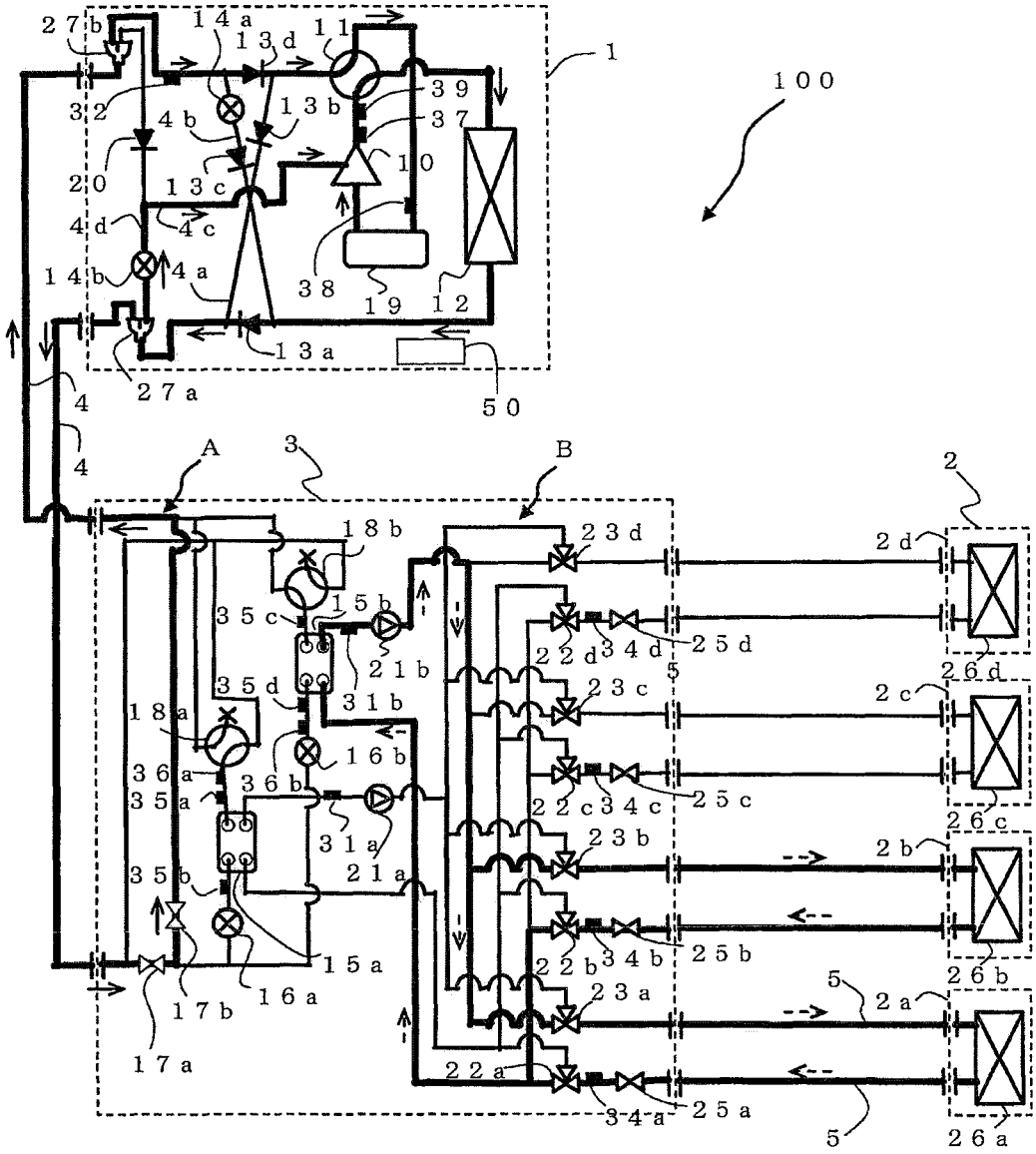
FIG. 13 is a refrigerant circuit diagram illustrating the flow of a refrigerant in a defrosting operation mode performed by the air-conditioning apparatus according to Embodiment 1 of the present invention.

FIG. 13 is a refrigerant circuit diagram illustrating the flow of a refrigerant in the defrosting operation mode of the air-conditioning apparatus according to Embodiment 1 of the present invention.

A refrigerant is compressed and heated by the compressor 10 and is discharged from the compressor 10. The refrigerant then flows into the heat source side heat exchanger 12 via the first refrigerant flow switching device 11. Then, the refrigerant transfers heat in the heat source side heat exchanger 12 and defrosts a portion around the heat source side heat exchanger 12. The refrigerant flowing out of the heat source side heat exchanger 12 passes through the check valve 13*a*, reaches the branch portion 27*a*, and is branched at the branch portion 27*a*.

The refrigerant diverted at the branch portion 27*a* in one direction flows out of the outdoor unit 1 and flows into the heat medium relay unit 3 via the refrigerant pipe 4. The refrigerant flowing into the heat medium relay unit 3 flows out of the heat medium relay unit 3 via the opening/closing devices 17*a* and 17*b* which are in the opened state, and again flows into the outdoor unit 1 via the refrigerant pipe 4. The refrigerant flowing into the outdoor unit 1 passes through the check valve 13*d* via the branch portion 27*b* and is again sucked into the compressor 10 via the first refrigerant flow switching device 11 and the accumulator 19. In this case, the expansion devices 16*a* and 16*b* are in the full closed state, or the opening degree of the expansion devices 16*a* and 16*b* is small to such a degree as not to allow a refrigerant to flow through the heat exchangers 15*a* and 15*b* related to heat medium, respectively.

The refrigerant diverted at the branch portion 27*a* in the other direction flows into the branch pipe 4*d* and is injected into the compression chamber of the compressor 10 via the expansion device 14*b* which is in the full opened state and the injection pipe 4*c*. The refrigerant then joins the refrigerant (which has been diverted at the branch portion 27*a* in the other direction) sucked into the compressor 10 via the accumulator 19.

In FIG. 13, the pump 21*b* is operated so as to cause a heat medium to circulate in the use side heat exchangers 26 which require heating (use side heat exchangers 26*a* and 26*b*). With this operation, even during the defrosting operation, a heating operation can continue by using heating energy stored in a heat medium. In the defrosting operation after the heating only operation, the pump 21*a* may also be operated. Alternatively, during the defrosting operation, the pumps 21*a* and 21*b* may be stopped, thereby discontinuing the heating operation.

As described above, in the defrosting operation, while defrosting a portion around the heat source side heat exchanger 12, a refrigerant is branched at the branch portion 27*a*, and the refrigerant diverted in one direction is injected into the compression chamber of the compressor 10. With this operation, residual heat in the compressor 10 can be easily transferred to the refrigerant directly, thereby performing the efficient defrosting operation. Additionally, the flow rate of a refrigerant circulating in the heat medium relay unit 3 which is separated from the outdoor unit 1 can be decreased by an amount of refrigerant to be injected, thereby reducing power of the compressor 10.

Embodiment 2

Figure 14:
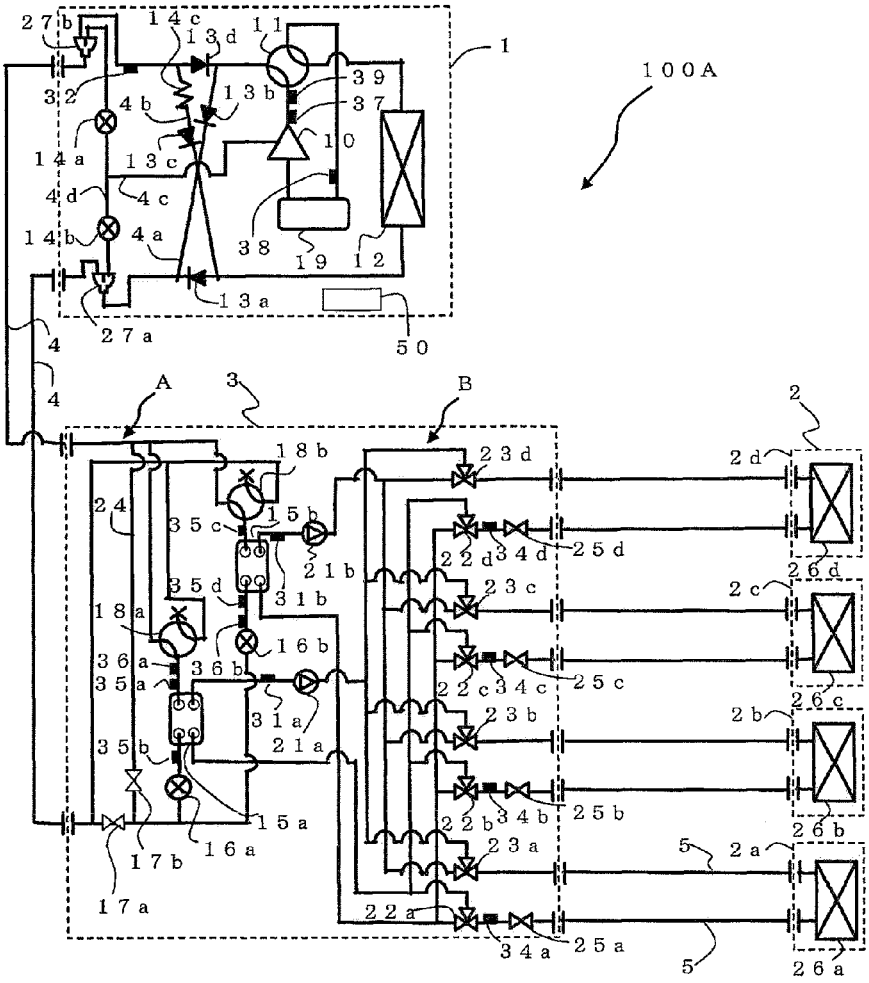
FIG. 14 is a schematic circuit diagram illustrating an example of the circuit configuration of an air-conditioning apparatus according to Embodiment 2 of the present invention.

FIG. 14 illustrates a configuration of an air-conditioning apparatus 100A according to Embodiment 2. In the air-conditioning apparatus 100A according to Embodiment 2, expansion devices 14*a*, 14*b*, and 14*c* are provided in the outdoor unit 1. That is, in Embodiment 1, a case in which the backflow preventing device 20 is provided has been discussed by way of example. In contrast, in Embodiment 2, the expansion device 14*a* is moved to the position at which the backflow preventing device 20 is disposed in Embodiment 1, and the expansion device 14*c* is provided at the position at which the expansion device 14*a* is disposed in Embodiment 1. As the expansion devices 14*a* and 14*b*, devices that can sequentially change the opening degree (aperture area), such as electronic expansion valves, are used. As the expansion device 14*c*, a fixed expansion valve, such as a capillary tube, or a valve with an expanding portion having a fixed aperture area, such as an on/off valve, for example, a solenoid valve having a small aperture area when it is opened, may be used. Basic operation modes are a cooling only operation mode, a heating only operation mode, a cooling main operation mode, and a heating main operation mode, which are similar to those of Embodiment 1. A description of detailed operations will be omitted here.

In the cooling only operation mode, a high-pressure liquid refrigerant is branched at the branch portion 27*a*, and by controlling the opening degree of the expansion device 14*b*, the flow rate of a refrigerant to be injected into the compression chamber of the compressor 10 via the branch pipe 4*d* and the injection pipe 4*c* is adjusted, thereby controlling the discharge temperature of the compressor 10. In this case, the expansion device 14*a* is set in the full closed state or the opening degree is set to be small to such a degree as not to allow a refrigerant to flow therethrough.

In the heating only operation mode, by controlling the opening degree of the expansion device 14*a*, the flow rate of a refrigerant to be injected into the compression chamber of the compressor 10 via the branch pipe 4*d* and the injection pipe 4*c* is adjusted. As a result, the flow rate of a refrigerant to flow into the expansion device 14*c* is also changed, and thus, the pressure of the refrigerant positioned on the upstream side of the expansion device 14*c* is changed. Accordingly, both of the intermediate pressure and the discharge temperature can be controlled. In this case, the expansion device 14*b* is set in the full closed state or the opening degree is set to be small to such a degree as not to allow a refrigerant to flow therethrough.

In the cooling main operation mode, a high-pressure two-phase refrigerant is branched at the branch portion 27*a*, and by controlling the opening degree of the expansion device 14*b*, the flow rate of a refrigerant to be injected into the compression chamber of the compressor 10 via the branch pipe 4*d* and the injection pipe 4*c* is adjusted, thereby controlling the discharge temperature of the compressor 10. In this case, the expansion device 14*a* is set in the full closed state or the opening degree is set to be small to such a degree as not to allow a refrigerant to flow therethrough.

In the heating main operation mode, by controlling the opening degree of the expansion device 14*a*, the flow rate of a refrigerant to be injected into the compression chamber of the compressor 10 via the branch pipe 4*d* and the injection pipe 4*c* is adjusted. As a result, the flow rate of a refrigerant to flow into the expansion device 14*c* is also changed, and thus, the pressure of the refrigerant positioned on the upstream side of the expansion device 14*c* is changed. Accordingly, both of the intermediate pressure and the discharge temperature can be controlled. In this case, the expansion device 14*b* is set in the full closed state or the opening degree is set to be small to such a degree as not to allow a refrigerant to flow therethrough.

As discussed above, during the cooling only operation mode and the cooling main operation mode in which the heat source side heat exchanger 12 serves as a condenser, by controlling the expansion device 14*b*, a high-pressure refrigerant is branched and is injected. During the heating only operation mode and the heating main operation mode in which the heat source side heat exchanger 12 serves as an evaporator, by controlling the expansion device 14*a*, an intermediate-pressure refrigerant is branched and is injected. The discharge temperature is controlled in this manner. As discussed above, the expansion device to be controlled is different depending on whether the heat source side heat exchanger 12 serves as a condenser or an evaporator, and by controlling one of the expansion devices, an amount of refrigerant to be injected is controlled.

A case in which, as the expansion device 14*c*, a device with an expanding portion having a fixed aperture area, such as a capillary tube, is used, has been discussed. With this configuration, a system can be configured at low cost. However, as the expansion device 14*c*, a device that can sequentially change the opening degree (aperture area), such as an electronic expansion valve, may be used without any problem, in which case, the aperture area similar to that described above can be realized. Additionally, as the expansion devices 14*a* and 14*b*, devices that can switch the aperture area in a stepwise manner may be used. This can be implemented by, for example, using and switching a plurality of capillary tubes.

Embodiment 3

In Embodiment 1 and Embodiment 2, the following system has been discussed by way of example. The compressor 10, the first refrigerant flow switching device 11, the heat source side heat exchanger 12, the expansion devices 14*a* and 14*b*, the opening/closing device 17, and the backflow preventing device 20 (the expansion device 14*c* in Embodiment 2) are stored in the outdoor unit 1. The use side heat exchanger 26 is stored in the indoor unit 2, and the heat exchanger 15 related to heat medium and the expansion device 16 are stored in the heat medium relay unit 3. Then, the outdoor unit 1 and the heat medium relay unit 3 are connected to each other with a pair of two pipes, and a heat source side refrigerant is caused to circulate between the outdoor unit 1 and the heat medium relay unit 3. The indoor unit 2 and the heat medium relay unit 3 are connected to each other with a pair of two pipes, and a heat medium is caused to circulate between the indoor unit 2 and the heat medium relay unit 3. Heat exchange between the heat source side refrigerant and the heat medium is performed in the heat exchanger 15 related to heat medium. However, the scope of the present invention is not restricted to such a system.

Thus, in Embodiment 3, another refrigerant circuit configuration will be described with reference to FIG. 15.

Figure 15:
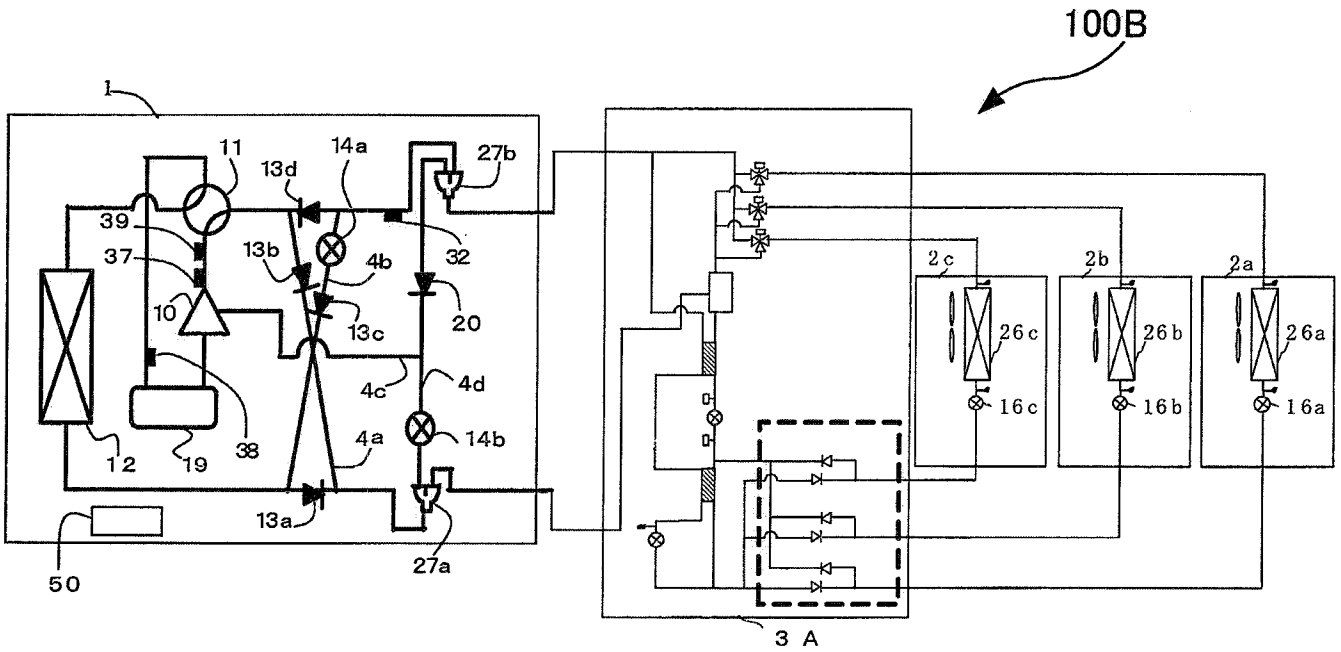
FIG. 15 is a schematic circuit diagram illustrating an example of the circuit configuration of an air-conditioning apparatus according to Embodiment 3 of the present invention.

FIG. 15 is a schematic diagram illustrating an example of the circuit configuration of an air-conditioning apparatus 1008 according to Embodiment 3 of the present invention.

For example, the compressor 10, the first refrigerant flow switching device 11, the heat source side heat exchanger 12, the expansion devices 14*a* and 14*b*, and the backflow preventing device 20 (or the expansion device 14*c*) are stored in the outdoor unit 1. The expansion device 16 and the use side heat exchanger 26, which serves as an evaporator or a condenser and performs heat exchange between air in an air-conditioned space and a refrigerant, are stored in the indoor unit 2. A relay unit 3A, which serves as a relaying unit formed separately from the outdoor unit 1 and the indoor unit 2, is provided. The outdoor unit 1 and the relay unit 3A are connected to each other with a pair of two pipes, and the indoor unit 2 and the relay unit 3A are connected to each other with a pair of two pipes. A refrigerant is caused to circulate between the outdoor unit 1 and the indoor unit 2 via the relay unit 3A. With this configuration, a cooling only operation, a heating only operation, a cooling main operation, and a heating main operation can be performed. The present invention is also applicable to such a direct expansion system, and similar advantages can be achieved.

The invention claimed is:

1. An air-conditioning apparatus in which a refrigerant circuit is formed by connecting a compressor, a refrigerant flow switching device, a first heat exchanger, a first expansion device, and a second heat exchanger to one another by using a pipe, due to working of the refrigerant flow switching device, a cooling operation and a heating operation are switchable, wherein the cooling operation is an operation in which the first heat exchanger serves as a condenser due to a high-pressure refrigerant being flowed into the first heat exchanger and the second heat exchanger serves as an evaporator due to a low-pressure refrigerant being flowed into part of or whole of the second heat exchanger, and the heating operation is an operation in which the first heat exchanger serves as an evaporator due to a low-pressure refrigerant being flowed into the first heat exchanger and the second heat exchanger serves as a condenser due to a high-pressure refrigerant being flowed into part of or whole of the second heat exchanger, the air-conditioning apparatus comprising:

an injection pipe that feeds the refrigerant into a compression chamber of the compressor, which is in a course of performing compression, from the outside of the compressor via an opening formed in part of the compression chamber;

a second expansion device;

a third expansion device;

a controller that controls the second expansion device during the heating operation so as to adjust a flow rate of the refrigerant to flow through the injection pipe and that controls the third expansion device during the cooling operation so as to adjust a flow rate of the refrigerant to flow through the injection pipe;

a first refrigerant branch portion that branches the refrigerant from a refrigerant flow channel through which the refrigerant flows from the first heat exchanger to the first expansion device;

a second refrigerant branch portion that branches the refrigerant from a refrigerant flow channel through which the refrigerant flows from the first expansion device to the first heat exchanger; and a branch pipe that connects the first refrigerant branch portion and the second refrigerant branch portion and is connected to the injection pipe, wherein the injection pipe is a pipe which connects the branch pipe and the compression chamber of the compressor which is in a course of performing compression, the second expansion device is provided at a position where a pressure of the refrigerant flowing from the second heat exchanger to the first heat exchanger through the first expansion device is made to be a middle pressure lower than the high pressure and higher than the low pressure, the third expansion device is provided between the first refrigerant branch portion and the opening of the compressor, at least one of the second expansion device and the third expansion device is a device which is capable of sequentially changing an aperture area, and includes an agitator for agitating a two-phase refrigerant, the agitator being positioned in an inlet pipe for a refrigerant, and the at least one of the second expansion device and the third expansion device is configured such that the distance between the agitator and an expanding portion of the at least one of the second expansion device and the third expansion device is six times or less as large as the internal diameter of the inlet pipe.

2. The air-conditioning apparatus of claim 1, further comprising:

a backflow preventing device provided between the second refrigerant branch portion and a connecting portion between the branch pipe and the injection pipe.

3. An air-conditioning apparatus in which a refrigerant circuit is formed by connecting a compressor, a refrigerant flow switching device, a first heat exchanger, a first expansion device, and a second heat exchanger to one another by using a pipe, due to working of the refrigerant flow switching device, a cooling operation and a heating operation are switchable, wherein the cooling operation is an operation in which the first heat exchanger serves as a condenser due to a high-pressure refrigerant being flowed into the first heat exchanger and the second heat exchanger serves as an evaporator due to a low-pressure refrigerant being flowed into part of or whole of the second heat exchanger, and the heating operation is an operation in which the first heat exchanger serves as an evaporator due to a low-pressure refrigerant being flowed into the first heat exchanger and the second heat exchanger serves as a condenser due to a high-pressure refrigerant being flowed into part of or whole of the second heat exchanger, the air-conditioning apparatus comprising:

an injection pipe that feeds the refrigerant into a compression chamber of the compressor, which is in a course of performing compression, from the outside of the compressor via an opening formed in part of the compression chamber;

a second expansion device;

a third expansion device;

a fourth expansion device;

a controller that controls the second expansion device during the heating operation so as to adjust a flow rate of the refrigerant to flow through the injection pipe and that controls the third expansion device during the cooling operation so as to adjust a flow rate of the refrigerant to flow through the injection pipe;

a first refrigerant branch portion that branches the refrigerant from a refrigerant flow channel through which the refrigerant flows from the first heat exchanger to the first expansion device;

a second refrigerant branch portion that branches the refrigerant from a refrigerant flow channel through which the refrigerant flows from the first expansion device to the first heat exchanger; and a branch pipe that connects the first refrigerant branch portion and the second refrigerant branch portion and is connected to the injection pipe, wherein the injection pipe is a pipe which connects the branch pipe and the compression chamber of the compressor which is in a course of performing compression, the second expansion device is provided between the second refrigerant branch portion and the opening of the compressor, the third expansion device is provided between the first refrigerant branch portion and the opening of the compressor, the fourth expansion device is provided at a position in a flow channel through which the refrigerant does not flow during the cooling operation and through which the refrigerant flows from the second refrigerant branch portion to the first heat exchanger during the heating operation, at least one of the second expansion device and the third expansion device is a device which is capable of sequentially changing an aperture area, and includes an agitator for agitating a two-phase refrigerant, the agitator being positioned in an inlet pipe for a refrigerant, and the at least one of the second expansion device and the third expansion device is configured such that the distance between the agitator and an expanding portion of the at least one of the second expansion device and the third expansion device is six times or less as large as the internal diameter of the inlet pipe.

4. The air-conditioning apparatus of claim 1, wherein, as the refrigerant circulating in the refrigerant circuit, R32, a mixed refrigerant of R32 and HFO1234yf, with a mass ratio of R32 being 62% or higher, or a mixed refrigerant of R32 and HFO1234ze, with a mass ratio of R32 being 43% or higher, is used.

5. The air-conditioning apparatus of claim 1, wherein the first refrigerant branch portion and the second refrigerant branch portion are configured such that a refrigerant flows from the bottom to the top side in the vertical direction.

6. The air-conditioning apparatus of claim 1, wherein the agitator is a porous metal having a porosity ratio (void ratio) of 80% or higher.

7. The air-conditioning apparatus of claim 1, wherein:

the compressor, the refrigerant flow switching device, and the first heat exchanger are stored in an outdoor unit;

the first expansion device and the second heat exchanger are stored in a heat medium relay unit;

the outdoor unit and the heat medium relay unit are connected to each other with two refrigerant pipes; and a cooling only operation mode is provided in which a high-pressure liquid refrigerant flows through one of the two refrigerant pipes and a low-pressure gas refrigerant flows through the other one of the two refrigerant pipes, and the high-pressure liquid refrigerant is branched at the first refrigerant branch portion and is caused to flow through the injection pipe; and a heating only operation mode is provided in which a high-pressure gas refrigerant flows through one of the two refrigerant pipes and an intermediate-pressure two-phase refrigerant flows through the other one of the two refrigerant pipes, and the intermediate-pressure two-phase refrigerant is branched at the second refrigerant branch portion and is caused to flow through the injection pipe.

8. The air-conditioning apparatus of claim 3, wherein:

the first expansion device and the second heat exchanger are stored in an indoor unit which is installed at a position at which the indoor unit is capable of air-conditioning an air-conditioning target space;

the compressor, the refrigerant flow switching device, the first heat exchanger, the second expansion device, the third expansion device, and the backflow preventing device are stored in an outdoor unit which is installed outdoor or in a machine room;

the outdoor unit and the indoor unit are separately formed, and a relaying unit which connects the outdoor unit and the indoor unit is provided;

the outdoor unit and the relaying unit are connected to each other with a pair of two refrigerant pipes, and the indoor unit and the relaying unit are connected to each other with a pair of two refrigerant pipes;

a cooling only operation mode is provided in which a high-pressure liquid refrigerant flows through one of the two refrigerant pipes and a low-pressure gas refrigerant flows through the other one of the two refrigerant pipes, and the high-pressure liquid refrigerant is branched at the first refrigerant branch portion and is caused to flow through the injection pipe; and a heating only operation mode is provided in which a high-pressure gas refrigerant flows through one of the two refrigerant pipes and an intermediate-pressure two-phase refrigerant flows through the other one of the two refrigerant pipes, and the intermediate-pressure two-phase refrigerant is branched at the second refrigerant branch portion and is caused to flow through the injection pipe.

9. The air-conditioning apparatus of claim 7, wherein:

a cooling main operation mode is provided in which a high-pressure two-phase refrigerant flows through one of the two refrigerant pipes and a low-pressure gas refrigerant flows through the other one of the two refrigerant pipes, and the high-pressure two-phase refrigerant is branched at the first refrigerant branch portion and is caused to flow through the injection pipe; and a heating main operation mode is provided in which a high-pressure gas refrigerant flows through one of the two refrigerant pipes and an intermediate-pressure two-phase refrigerant flows through the other one of the two refrigerant pipes, and the intermediate-pressure two-phase refrigerant is branched at the second refrigerant branch portion and is caused to flow through the injection pipe.

10. The air-conditioning apparatus of claim 1, wherein, during the heating operation, the controller controls the second expansion device so that a state quantity corresponding to a refrigerant discharged from the compressor will approximate a target value, will not exceed the target value, or will be within a target range, and, during the cooling operation, the controller controls the third expansion device so that a state quantity corresponding to a refrigerant discharged from the compressor will approximate a target value, will not exceed the target value, or will be within a target range, thereby regulating a flow rate of the refrigerant to be injected to the compression chamber of the compressor.

11. The air-conditioning apparatus of claim 1, further comprising a discharge temperature detecting device that is capable of detecting a discharge temperature of the compressor, wherein, during the heating operation, the controller controls the second expansion device so that the discharge temperature will approximate a target value, will not exceed a target temperature, or will be within a target range, and, during the cooling operation, the controller controls the third expansion device so that the discharge temperature will approximate a target value, will not exceed a target temperature, or will be within a target range, thereby regulating a flow rate of the refrigerant to be injected to the compression chamber of the compressor.

12. The air-conditioning apparatus of claim 10, further comprising a discharge temperature detecting device that is capable of detecting a discharge temperature of the compressor, and a high-pressure detecting device that is capable of detecting a high pressure of the compressor, wherein, during the heating operation, the controller controls the second expansion device so that discharge superheat calculated from the discharge temperature and the high pressure will approximate a target value, will not exceed a target degree of superheat, or will be within a target range, and, during the cooling operation, the controller controls the third expansion device so that discharge superheat calculated from the discharge temperature and the high pressure will approximate a target value, will not exceed a target degree of superheat, or will be within a target range.

13. The air-conditioning apparatus of claim 7, further comprising an indoor unit which is installed at a position at which the indoor unit is capable of air-conditioning an air-conditioning target space and which stores therein a use side heat exchanger that exchanges heat with air in the air-conditioning target space, wherein:

the indoor unit and the heat medium relay unit are connected to each other with a pair of two heat medium pipes through which a heat medium, which is different from a refrigerant, circulates; and heat exchange is performed between the refrigerant and the heat medium in the second heat exchanger.

14. The air-conditioning apparatus of claim 3, wherein, as the refrigerant circulating in the refrigerant circuit, R32, a mixed refrigerant of R32 and HFO1234yf, with a mass ratio of R32 being 62% or higher, or a mixed refrigerant of R32 and HFO1234ze, with a mass ratio of R32 being 43% or higher, is used.

15. The air-conditioning apparatus of claim 3, wherein the first refrigerant branch portion and the second refrigerant branch portion are configured such that a refrigerant flows from the bottom to the top side in the vertical direction.

16. The air-conditioning apparatus of claim 3, wherein:

the compressor, the refrigerant flow switching device, and the first heat exchanger are stored in an outdoor unit;

the first expansion device and the second heat exchanger are stored in a heat medium relay unit;

the outdoor unit and the heat medium relay unit are connected to each other with two refrigerant pipes; and a cooling only operation mode is provided in which a high-pressure liquid refrigerant flows through one of the two refrigerant pipes and a low-pressure gas refrigerant flows through the other one of the two refrigerant pipes, and the high-pressure liquid refrigerant is branched at the first refrigerant branch portion and is caused to flow through the injection pipe; and a heating only operation mode is provided in which a high-pressure gas refrigerant flows through one of the two refrigerant pipes and an intermediate-pressure two-phase refrigerant flows through the other one of the two refrigerant pipes, and the intermediate-pressure two-phase refrigerant is branched at the second refrigerant branch portion and is caused to flow through the injection pipe.

17. The air-conditioning apparatus of claim 16, wherein:

a cooling main operation mode is provided in which a high-pressure two-phase refrigerant flows through one of the two refrigerant pipes and a low-pressure gas refrigerant flows through the other one of the two refrigerant pipes, and the high-pressure two-phase refrigerant is branched at the first refrigerant branch portion and is caused to flow through the injection pipe; and a heating main operation mode is provided in which a high-pressure gas refrigerant flows through one of the two refrigerant pipes and an intermediate-pressure two-phase refrigerant flows through the other one of the two refrigerant pipes, and the intermediate-pressure two-phase refrigerant is branched at the second refrigerant branch portion and is caused to flow through the injection pipe.

18. The air-conditioning apparatus of claim 1, wherein the agitator and the expanding portion are both located within the at least one of the second expansion device and the third expansion device.

19. The air-conditioning apparatus of claim 3, wherein the agitator and the expanding portion are both located within the at least one of the second expansion device and the third expansion device.

* * * * *